US007280125B2

(12) United States Patent
Sagano et al.

(10) Patent No.: US 7,280,125 B2
(45) Date of Patent: Oct. 9, 2007

(54) IMAGE DISPLAY APPARATUS

(75) Inventors: Osamu Sagano, Tokyo (JP); Kohei Inamura, Kanagawa (JP); Naoto Abe, Tokyo (JP); Hiroshi Saito, Kanagawa (JP); Takeshi Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 661 days.

(21) Appl. No.: 10/775,083

(22) Filed: Feb. 11, 2004

(65) Prior Publication Data

US 2004/0257386 A1 Dec. 23, 2004

(30) Foreign Application Priority Data

Feb. 14, 2003 (JP) ..... 2003-037396

(51) Int. Cl.
*G09G 5/10* (2006.01)

(52) U.S. Cl. ..... 345/690; 345/74; 345/60

(58) Field of Classification Search ..... 345/690, 345/74, 60

See application file for complete search history.

(56) References Cited

U.S. PATENT DOCUMENTS

| | | | | |
|---|---|---|---|---|
| 5,224,480 | A * | 7/1993 | Yamada et al. | 600/442 |
| 5,734,361 | A | 3/1998 | Suzuki et al. | 345/74 |
| 6,177,914 | B1 * | 1/2001 | Iwama et al. | 345/60 |
| 6,429,836 | B1 * | 8/2002 | Hansen | 345/74.1 |
| 6,580,407 | B1 | 6/2003 | Suzuki et al. | 345/74.1 |
| 2003/0030654 | A1 | 2/2003 | Sagano et al. | 345/660 |
| 2003/0122759 | A1 | 7/2003 | Abe et al. | 345/89 |

FOREIGN PATENT DOCUMENTS

| | | |
|---|---|---|
| JP | 8-248920 | 9/1996 |
| JP | 2759483 | 3/1998 |
| JP | 2000-75833 | 3/2000 |

* cited by examiner

*Primary Examiner*—Richard Hjerpe
*Assistant Examiner*—Leonid Shapiro
(74) *Attorney, Agent, or Firm*—Fitzpatrick, Cella, Harper & Scinto

(57) ABSTRACT

In an image display apparatus, image data on which gradation conversion for compensating phosphor saturation has been carried out by a gradation convertor (200) undergoes voltage drop compensation and then amplitude regulation using a gain (Gd) before being fed to modulating means (8). Here, the gradation convertor (200) changes its conversion characteristic (the region of a compensation table it uses) in accordance with the value of the gain (Gd). As a result it is possible to compensate the affects of phosphor saturation characteristics and voltage drop and an excellent image can be displayed.

10 Claims, 29 Drawing Sheets

(a)

(b)

CA = ((Xn+1−x)*CData[k][n] + (x−Xn)*CData[k][n+1])/(Xn+1−Xn)

CB = ((Xn+1−x)*CData[k+1][n] + (x−Xn)*CData[k+1][n+1])/(Xn+1−Xn)

CD = CA*(Dk+1−data)+CB*(data−Dk)/(Dk+1−Dk)

IMAGE DISPLAY APPARATUS

BACKGROUND OF THE INVENTION

1. Field of the Invention

This invention relates to an image display apparatus such as a television receiver or a display unit for receiving a television signal or a display signal from a computer or the like and displaying an image using a display panel having multiple image-forming devices wired in a matrix.

2. Description of the Related Art

An image display apparatus of related art has n×m image-forming devices (display devices) wired to m row lines and n column lines arranged in the form of a matrix and drives all the devices of a row simultaneously by performing sequential scanning of the row lines and performing modulation in the column direction.

When driving is carried out like this, there is the problem that a voltage drop in the row line arising due to the electrical resistance of the lines causes dispersion in the voltages applied to the image-forming devices.

In this connection, an image display apparatus wherein the pulse widths of driving pulses applied to the image-forming devices are compensated with the purpose of compensating this kind of dispersion of the voltages applied to the image-forming devices is disclosed in Japanese Patent Publication No. 2,759,483.

And, technology relating to an image display apparatus is disclosed in JP-A-8-248,920 (FIG. 22) wherein, in view of the problem that the affect of luminance decrease caused by this kind of voltage drop due to line resistance varies with the inputted image data, the inputted image data is statistically processed, compensation data for compensating the affect is computed, and the image data is combined with compensation data.

However, in the related art mentioned above, because there is no consideration of the fact that the light emission (luminance) characteristics of phosphors (image-forming members) differ from color to color, although the affect of voltage drop is considerably moderated, there has been a need for improvement taking account of the light emission characteristics of the phosphors. Compensation of the light emission characteristic of a phosphor is proposed in JP-A-2000-75,833.

In JP-A-2000-75,833 it is mentioned that the light emission luminance of a phosphor with respect to the strength of an electron beam directed at the phosphor is nonlinear and there is a saturation tendency (hereinafter referred to as nonlinear characteristic, phosphor saturation, phosphor saturation characteristic, etc.). Also, it is mentioned that the phosphor saturation characteristic varies with the type of the phosphor and the beam density and beam duration of the electron beam directed at the phosphor. And it is also mentioned that when the voltage applied to an image-forming device is controlled by means of an ABL (Auto Brightness Limiter) or the like, the light emission characteristic of the phosphor varies with variation in the beam density and duration of the electron beam.

However, even in JP-A-2000-75,833 sufficient examination is not made of voltage drop arising or of any construction incorporating a circuit for compensating this in an image display apparatus which performs gradation conversion of inputted image data corresponding to the light emission characteristics of the phosphors, and further improvement has been needed.

Also, although the present inventors have researched an image display apparatus having processing circuits which both take into account the saturation characteristic of the phosphor and compensate the affects of voltage drop, it was found that when it was made to operate with those in combination, good display of moving pictures was not possible.

SUMMARY OF THE INVENTION

It is therefore an object of the present invention to provide an image display apparatus, of the kind that uses image-forming members having a nonlinear characteristic with respect to a driving condition of an image-forming device, which compensates the affect of voltage drop and displays a good image.

It is another object of the invention to provide an image display apparatus, of the kind that uses image-forming members having a nonlinear characteristic with respect to a driving condition of an image-forming device and compensates the affect of voltage drop, which displays a good image even when displaying a moving picture (moving image).

To achieve the above-mentioned objects, the invention provides an image display apparatus including: multiple image-forming devices connected to multiple row lines and column lines and disposed in the form of a matrix; scanning means connected to the row lines; modulating means connected to the column lines; image-forming members severally associated with the image-forming devices and having a nonlinear characteristic with respect to a driving condition of the image-forming devices; gradation converting means for converting a gradation characteristic of inputted image data in accordance with the characteristic of the image-forming members; compensated image data computing means for computing compensated image data by compensating the output of the gradation converting means for at least an affect of voltage drop arising due to resistance of the row lines; and amplitude regulating means for applying a gain for regulating the amplitude of the compensated image data so that the amplitude of the compensated image data corresponds with an input range of the modulating means, wherein the gradation converting means performs a gradation conversion corresponding to the gain and the modulating means receives the compensated image data amplitude-regulated by the amplitude regulating means as input and outputs a modulating signal to the column lines.

According to the invention, notwithstanding the nonlinear characteristic of the image-forming members, it is possible to display an image linearly with respect to a driving condition of the image-forming devices; to compensate the affect of voltage drop caused by line resistance; and thereby to display an excellent image.

Preferably, the image display apparatus has a scene change detecting portion for detecting a change of a displayed scene, and the amplitude regulating means has filtering means for carrying out different filter processing in accordance with the output of the scene change detecting portion on the gain computed for each frame.

In this case, it is possible to display an excellent image even when displaying a moving picture.

The invention also provides an image display apparatus including: multiple image-forming devices connected to multiple row lines and column lines and disposed in the form of a matrix; scanning means connected to the row lines; modulating means connected to the column lines; image-forming members severally associated with the image-forming devices and having a nonlinear characteristic with respect to a driving condition of the image-forming devices; gradation converting means for converting a gradation characteristic of inputted image data in accordance with the characteristic of the image-forming members; gain multiplying means for multiplying an output of the gradation converting means by a gain; compensated image data computing means for computing compensated image data by compensating the image data gain-multiplied by the gain multiplying means for at least an affect of voltage drop arising due to resistance of the row line; and gain computing means for computing the gain so that the amplitude of the compensated image data corresponds with an input range of the modulating means, wherein the gradation converting means performs a gradation conversion corresponding to the gain and the modulating means receives the compensated image data amplitude-regulated by the amplitude regulating means as input and outputs a modulating signal to the column lines.

According to the invention, notwithstanding the nonlinear characteristic of the image-forming members, it is possible to display an image linearly with respect to a driving condition of the image-forming devices; to compensate the affect of voltage drop caused by line resistance; and thereby to display an excellent image.

Preferably, the image display apparatus has a scene change detecting portion for detecting a change of a displayed scene, and filtering means for carrying out different filter processing in accordance with the output of the scene change detecting portion on the gain computed for each frame.

In this case, it is possible to display an excellent image even when displaying a moving picture.

Optionally, the filtering means is a low pass filter and weakens the strength of the filter with respect to a predetermined frame immediately after a scene change is detected by the scene change detecting portion.

Optionally, the filtering means does not perform filter processing with respect to a predetermined frame immediately after a scene change is detected by the scene change detecting portion and operates as a low pass filter with respect to frames other than the predetermined frame immediately after the scene change is detected.

Optionally, the filtering means alters the value of the gain to a preset value with respect to a predetermined frame immediately after a scene change is detected by the scene change detecting portion and operates as a low pass filter with respect to frames other than the predetermined frame immediately after the scene change is detected.

Optionally, the filtering means, with respect to a predetermined frame immediately after a scene change is detected by the scene change detecting portion, alters the value of the gain to a value estimated with reference to an average value of inputted image data of the frame, and with respect to frames other than the predetermined frame immediately after the scene change is detected operates as a low pass filter.

Preferably, the predetermined frame is from one frame to five frames immediately after a scene change is detected in the scene change detecting part.

Preferably, the scene change detecting portion has means for computing an average value of inputted image data for each frame and means for calculating a difference in the average value between frames and comparing the absolute value of this difference with a preset value to determine whether or not there has been a scene change.

Optionally, the image-forming devices are electron-emitting devices which emit electrons, the image-forming members are phosphors which emit light when irradiated with electrons emitted from the electron-emitting devices, and the gradation converting means performs conversion on the basis of nonlinear conversion characteristics, differing by color of the inputted image data, obtained from the light emission characteristic of the phosphor.

As described above, with an image display apparatus according to the present invention, the affects of nonlinear characteristics with respect to driving conditions of image-forming devices and of voltage drop can be compensated and a good image displayed. Also, an excellent image can be displayed even when a moving picture is displayed.

DESCRIPTION OF THE PREFERRED EMBODIMENTS

Figure 1:
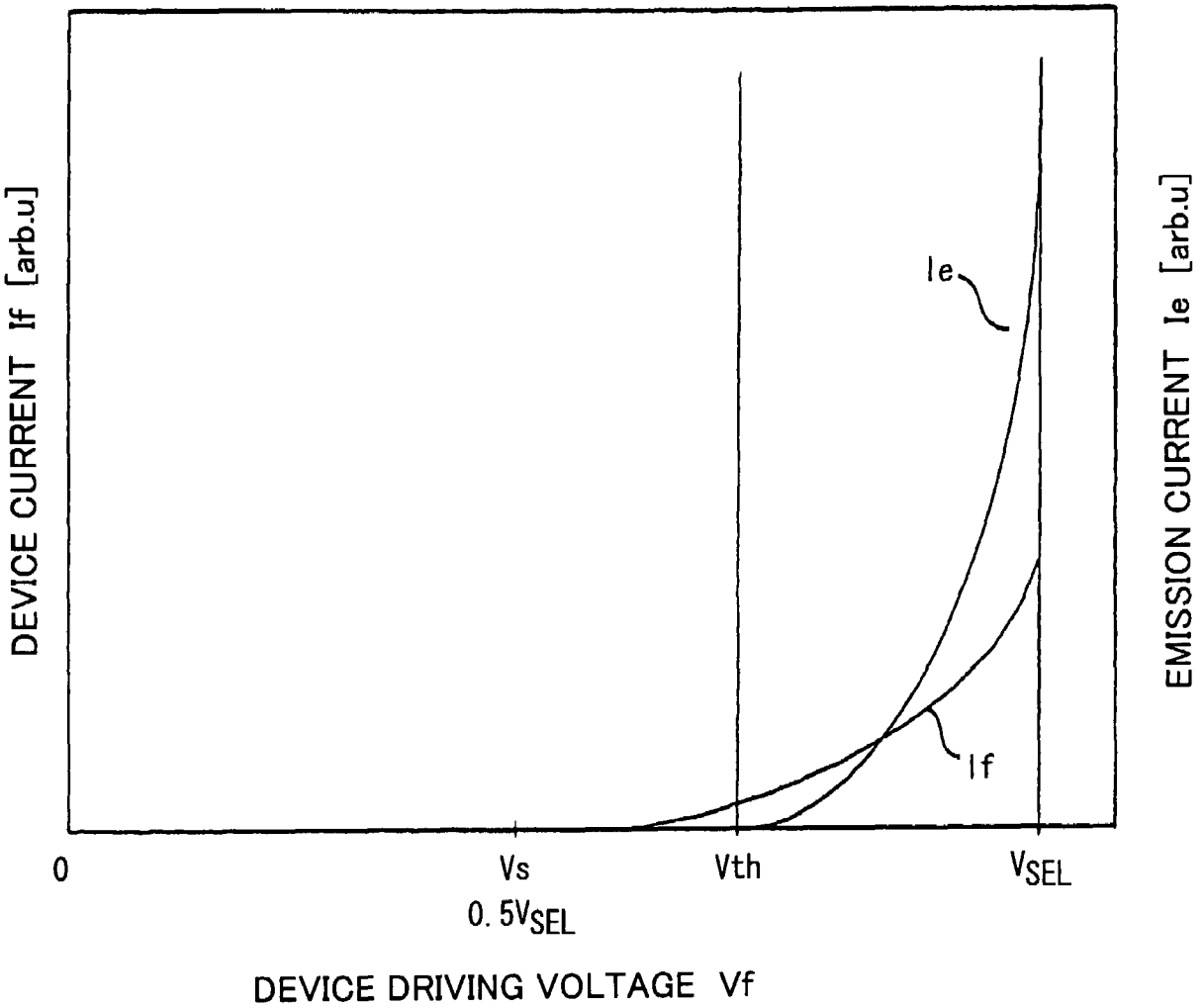
FIG. 1 is a view showing characteristics of a surface conduction electron-emitting device.

A number of presently preferred embodiments of the invention are described in detail below with reference to the accompanying drawings. However, except where specifically stated otherwise, the scope of the invention is not limited to the dimensions, materials, shapes and relative positions of the constituent parts mentioned in these preferred embodiments.

First Preferred Embodiment

In an image display apparatus having cold cathode devices disposed in a passive matrix, as a result of a current flowing into a scan line (row line) and a line resistance of the scan line, voltage drops arise, the drive voltages applied to the cold cathode devices fall, and consequently a fall in emission current and falls in luminance (brightness) occur. Also, in a phosphor serving as an image-forming member irradiated with an electron beam, a phenomenon of the light emission not being linear with respect to the beam density and beam duration of the electron beam (phosphor saturation) occurs.

This invention relates to technology for beneficially compensating these problems of phosphor saturation and voltage drop. The present inventors have performed studies into a construction for computing a gain of the kind discussed below to perform luminance (brightness) control of a whole screen and changing a conversion characteristic for compensating phosphor saturation in accordance with the gain.

However, it was found that in this kind of image display apparatus there is the problem that, when a moving picture is displayed, a sense of incongruity caused by the gain control arises. In this preferred embodiment, an image display apparatus is described which can resolve this problem.

In the following, first, an image display apparatus which compensates the affects of phosphor saturation and voltage drop studied by the present inventors will be described, and then control carried out at times of scene changes will be explained.

In the following, the characteristics of a surface conduction electron-emitting device constituting an image-forming device according to an embodiment of the invention, a display panel driving method, the mechanism of voltage drop caused by the electrical resistance of scan lines, and a method and apparatus for compensating such voltage drop will be described.

Because an outline of a display panel of a passive matrix image display apparatus pertaining to an embodiment of the invention is given in JP-A-2000-75833, here this will be skipped.

A display panel of this preferred embodiment has a single vacuum vessel formed by a rear plate with surface conduction electron-emitting devices connected in a passive matrix structure, a face plate on which are formed phosphors to be irradiated by an electron beam in positions facing the surface conduction electron-emitting devices, and a support frame supporting the plates. A high voltage Va is supplied across the face plate and the rear plate so that the face plate side becomes an anode, and image display is carried out by control of voltages (device driving voltages Vf) applied across modulation electrodes (column lines) and scan electrodes (row lines) of the passive matrix. The surface conduction electron-emitting devices have an emission current Ie vs. device driving voltage Vf characteristic and a device current If vs. device driving voltage Vf characteristic of the kind shown in FIG. 1. Because the emission current Ie is much smaller than the device current If and to show them on the same scale is difficult, the two graphs are shown with different scales.

The surface conduction electron-emitting devices have the following three characteristics in relation to the emission current Ie.

Firstly, when a voltage above a certain voltage (this is called the threshold voltage Vth) is applied to a device, the emission current Ie increases steeply, but when on the other hand the voltage is below the threshold voltage Vth, almost no emission current Ie is detected.

That is, it is a nonlinear device having a clear threshold voltage Vth with respect to the emission current Ie.

Secondly, because the emission current Ie varies depending on the voltage Vf applied to the device, by varying the voltage Vf it is possible to control the size of the emission current Ie.

Thirdly, because cold cathode devices are highly responsive, the emission time of the emission current Ie can be controlled by the application time of the voltage Vf.

By utilizing these characteristics, it is possible to use surface conduction electron-emitting devices well in a display device. For example, by utilizing the first characteristic, it is possible to effect display by sequentially scanning a display screen. That is, to devices to be driven, a suitable voltage above the threshold voltage Vth is applied according to the required light emission luminance; and to non-selected devices a voltage below the threshold voltage Vth is applied. By sequentially changing the devices being driven, it is possible to sequentially scan the display screen and effect display.

By utilizing the second characteristic, it is possible to control the light emission luminance of a phosphor by means of the size of the voltage applied to a device, and display of an image can be effected.

And by utilizing the third characteristic, it is possible to control the light emission time of the phosphor by means of the time for which a voltage Vf is applied to the device, and display of an image can be effected.

In an image display apparatus according to a preferred embodiment of the invention, modulation was carried out using the third characteristic.

Figure 2:
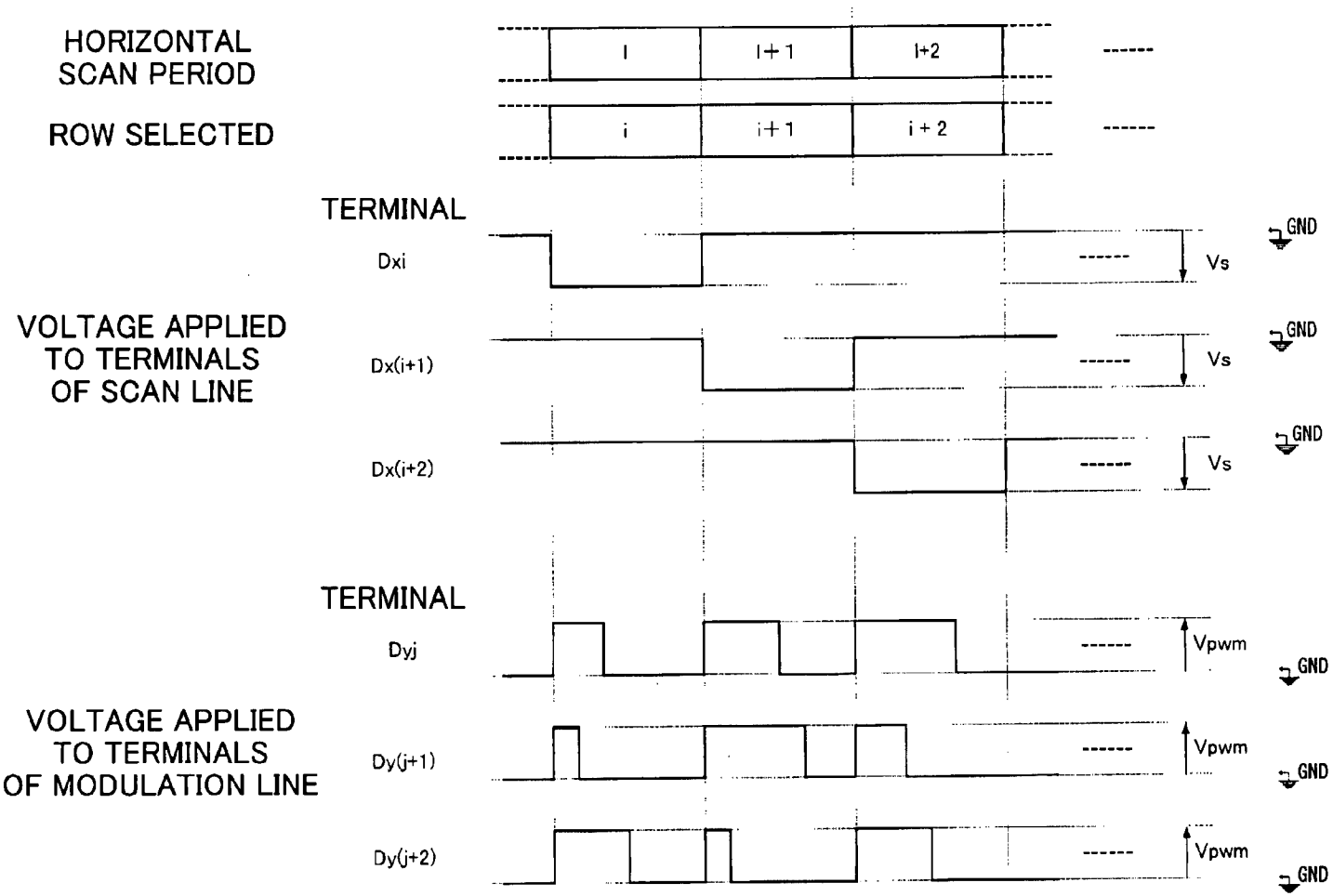
FIG. 2 is a view showing a driving method of a display panel.

FIG. 2 is an example of voltages applied to voltage supply terminals of scan lines (row lines) and modulation lines (column lines). Here, it will be assumed that there is no voltage drop.

Now, the horizontal scan period I is the period for which the pixels of the ith row are made to emit light.

To make the pixels of the ith row emit light, a selection potential Vs is applied to the voltage supply terminal Dxi of the ith scan line so that the ith scan line becomes a selected state. And a deselection potential Vns is applied to the voltage supply terminals D×k (k=1, 2, . . . N, k≠i) of the other scan lines so that them become a deselected state.

In this example, the selection potential Vs is set to −0.5VSEL, half of the voltage VSEL shown in FIG. 1, and the deselection voltage Vns is made GND potential. (The voltage VSEL is defined as the driving voltage value which should be applied across the terminals of a surface conduction electron-emitting device to display an image.)

And, a pulse width modulated signal of voltage amplitude Vpwm is supplied to the voltage supply terminals of the modulation lines. In related art, when compensation is not carried out, the pulse width of the pulse width modulated signal supplied to the jth modulation line has been determined in accordance with the value of the image data of the ith row, jth pixel of the image being displayed, and pulse width modulated signals corresponding to the values of the image data of the respective pixels have been supplied to all the modulation lines.

Here, the voltage Vpwm was set to +0.5VSEL.

As shown in FIG. 1, when the voltage VSEL is applied to the terminals of a surface conduction electron-emitting device it emits electrons, and when the applied voltage is a lower voltage than Vth it emits no electrons at all.

The voltage Vth is greater than 0.5VSEL. Consequently, no electrons are emitted from surface conduction electron-emitting devices connected to scan lines to which the deselection voltage Vns is being applied.

And while the output of modulating means is the ground potential (output='L'), because the voltage applied to the terminals of the surface conduction electron-emitting devices on the selected scan line is Vs, electrons are not emitted.

From the surface conduction electron-emitting devices on the scan line to which the selection potential Vs is being applied, while the output of pulse width modulating means is Vpwm (output='H'), electrons are emitted and the phosphor emits light. The image display apparatus of this preferred embodiment displays an image by carrying out this kind of line-sequential scanning and pulse width modulation.

Next, the mechanism by which voltage drop occurs will be explained.

Although it does depend on the design specifications and manufacturing method of the surface conduction electron-emitting device, the device current of one surface conduction electron-emitting device when the voltage VSEL is applied is less than 100 μA.

Consequently, when only one pixel of the selected row is lit, because the device current flowing into the scan line of the selected row from a modulation line is only the current of one pixel, very little voltage drop occurs and there is no fall in light emission luminance.

However, when all the pixels of the selected row are lit, because currents of all the pixels flow into the selected scan line from all of the modulation lines, the total current is up to several hundred mA, and the line resistance of the scan line causes a voltage drop to occur in the scan line.

If a voltage drop occurs in the scan line, the voltages applied to the surface conduction electron-emitting devices fall. Consequently the emission currents emitted from the surface conduction electron-emitting devices fall and the light emission luminance falls.

And, as a further complication, as a result of pulse width modulation being carried out, even within a single horizontal scan period the size of the voltage drop changes. When the pulse width modulation signals supplied to the columns are pulse width modulated signals whose rises are synchronized, generally the number of lit pixels is greater the sooner after the pulses have risen it is, and thereafter the pixels go off in order from the areas of lowest luminance, and consequently the number of lit pixels decreases with time within the horizontal scan period.

Therefore, a voltage drop which occurs in the scan line also gradually decreases after the pulses have risen.

(Phosphor Saturation Characteristic)

In JP-A-2000-75,833 it is mentioned that the light emission characteristic of a phosphor is not linear with respect to the strength of the electron beam irradiating it but rather varies with the type of the phosphor and the beam density and beam duration of the electron beam irradiating the phosphor. Generally the light emission characteristic of a phosphor is such that the longer is the beam duration and the stronger is the beam strength the lower is the light emission luminance. (This is called phosphor saturation.)

Also, the present inventors investigated this light emission characteristic with the duration of the electron beam (=pulse width) and the instantaneous electron beam irradiation level (=emission current) as parameters. As a result it was found that if emitted charge quantity is defined as the product of emission current and pulse width and emitted light is plotted against emitted charge quantity, the light emission characteristic of a phosphor can be roughly approximated to a single curve for each color. This approximation can be made particularly well in the case of a red phosphor. This is likely to be because, although it depends on the material of the phosphor, in general the relaxation time of a red phosphor is extremely long compared to the time for which it is irradiated by the electron beam.

Figure 3:
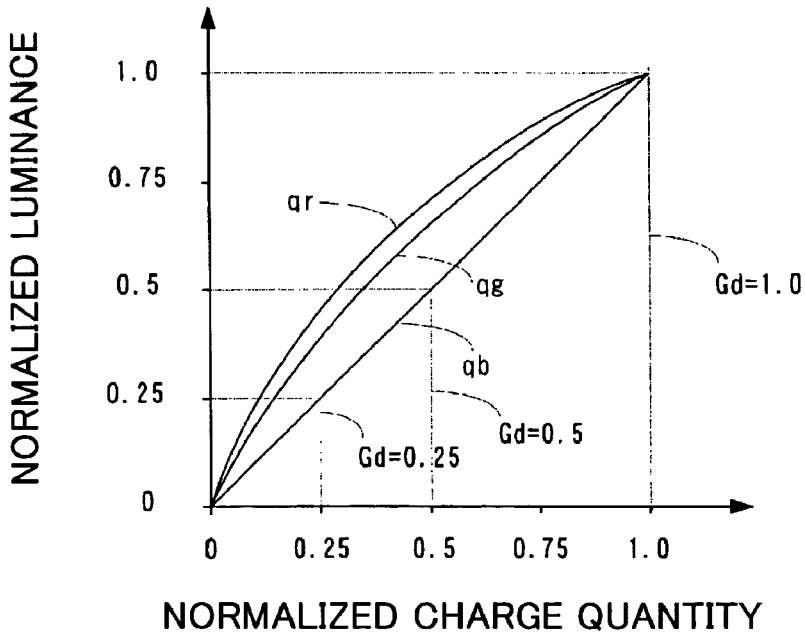
FIG. 3 is a view showing emitted charge quantity vs. light emission luminance characteristics of phosphors.
Figure 3:
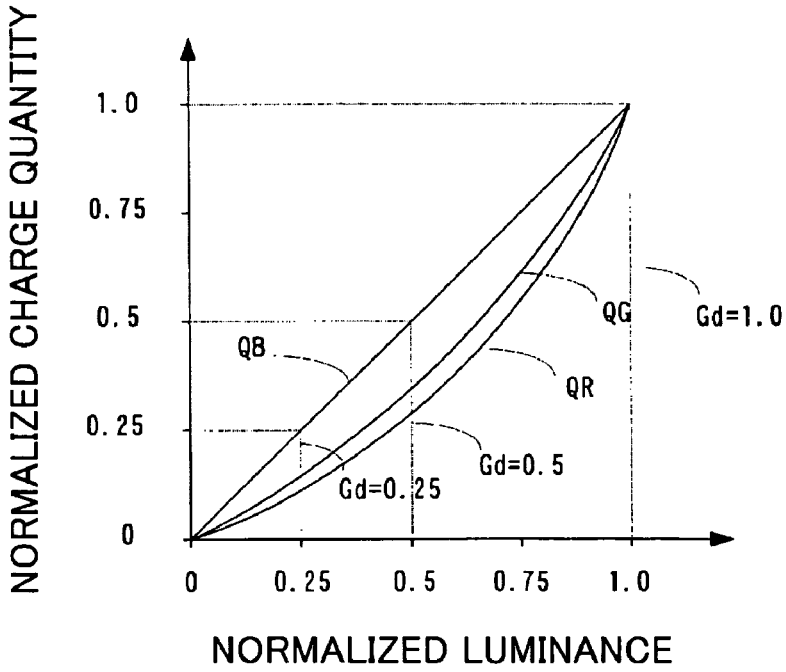

FIG. 3(*a*) is a view showing relationships between emitted charge quantity and luminance. In the figure the horizontal axis shows normalized emitted charge quantity, plotted with the charge quantity of when the emission current level of the case where there is no voltage drop is irradiated for the maximum time for which modulation is possible as 1.

The vertical axis shows normalized light emission luminance of the phosphor, plotted with the luminance corresponding to the charge quantity described above as 1. The three curves shown as qr, qg and qb are characteristics of red, green and blue phosphors respectively. As mentioned above, although the light emission characteristics differ from phosphor to phosphor, they can be approximated to a single curve with respect to emitted charge quantity.

(Voltage Drop Compensation)

A construction for dealing with the affect of voltage drop by compensating the pulse widths of driving pulses is disclosed in Japanese Patent Publication No. 2759483. After many further studies since then, the inventors consider that to compensate the pulse width of a modulated pulse it is desirable to extend the pulse width in accordance with the concept shown in FIG. 4.

Figure 4:
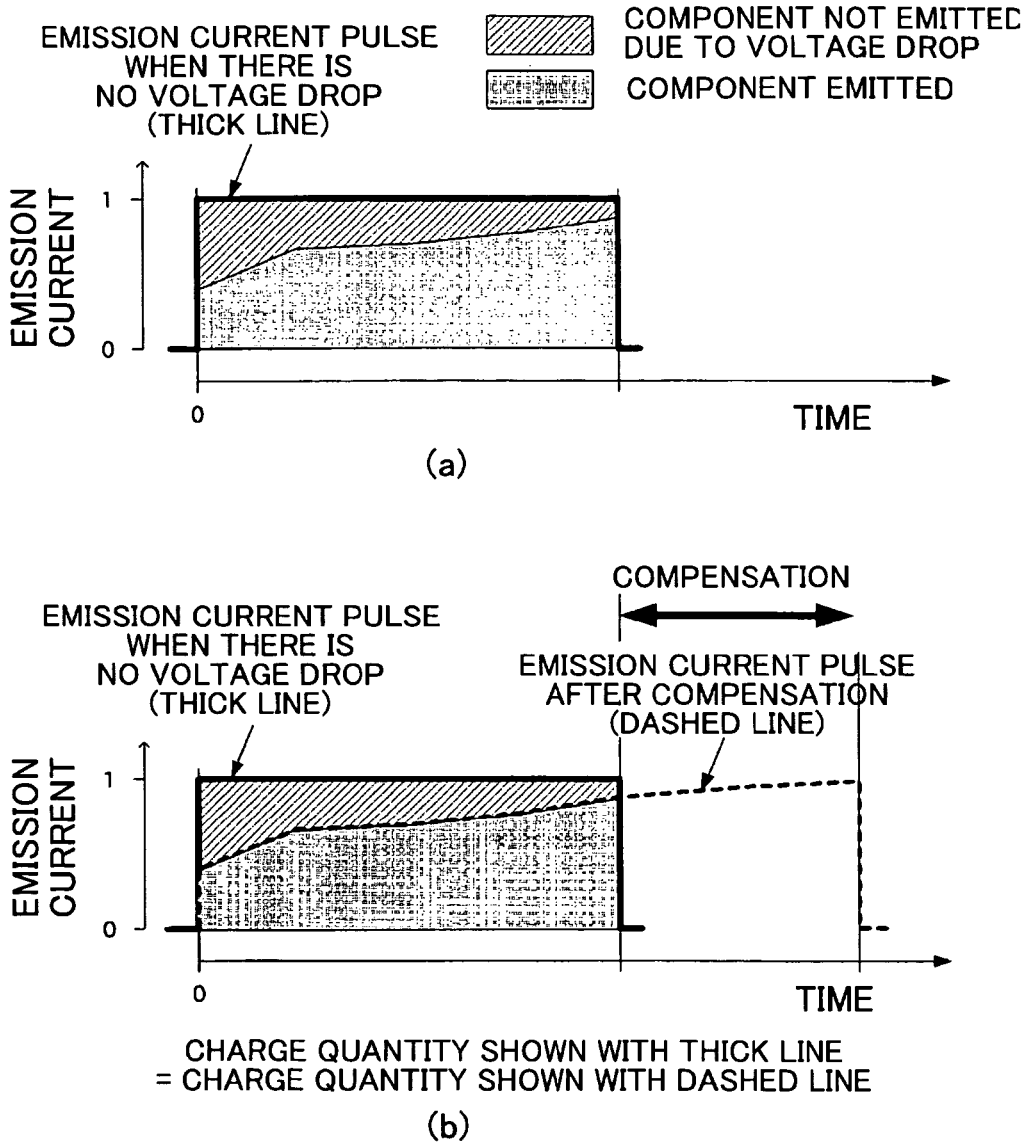
FIG. 4 is a view illustrating a voltage drop compensation concept of the invention.

FIG. 4 is a chart schematically illustrating an emission current pulse outputted from an image-forming device, with time on the horizontal axis and emission current on the vertical axis. In FIG. 4 the emission current level is plotted normalized with the emission current outputted when there is no affect of voltage drop and the voltage VSEL is applied to the image-forming device as 1.

When there is no affect of voltage drop, the amplitude of the emission current is 1 and an emission current pulse of a pulse width determined by the image data is outputted, as shown by the thick line in FIG. 4(*a*); however, in reality, because a voltage drop occurs, the emission current corresponding to the hatched area is not emitted, and only that corresponding to the gray area is emitted.

With respect to this, the concept of voltage drop compensation of this preferred embodiment is to compensate the pulse width of the driving pulse so as to reach the same charge quantity as the driving pulse shown with the thick line, and as shown in FIG. 4(*b*) to produce a driving pulse like that shown with a dashed line so as to achieve the same emitted charge quantity as that corresponding to the driving pulse shown with the thick line.

Accordingly, in the voltage drop compensation of this preferred embodiment, it is calculated for the inputted image data how the voltage drop will change in time and in space when the corresponding modulation is carried out; compensated image data is computed; and modulation is carried out on the basis of the compensated image data. (A detailed calculation method will be described later under the headings "Voltage Drop Calculation Method" and "Calculation of Compensation Data from Voltage Drops").

(Overflow Processing)

Thus, voltage drop compensation is carried out by extending the pulse width of the drive pulse. However, in reality, the pulse width (modulation time) of the drive pulse cannot be extended infinitely, and there is an upper limit to the modulation time. When the post-compensation pulse width rises above the upper limit, because it cannot be extended further, display cannot be effected well (this phenomenon is defined as overflow).

Figure 5:
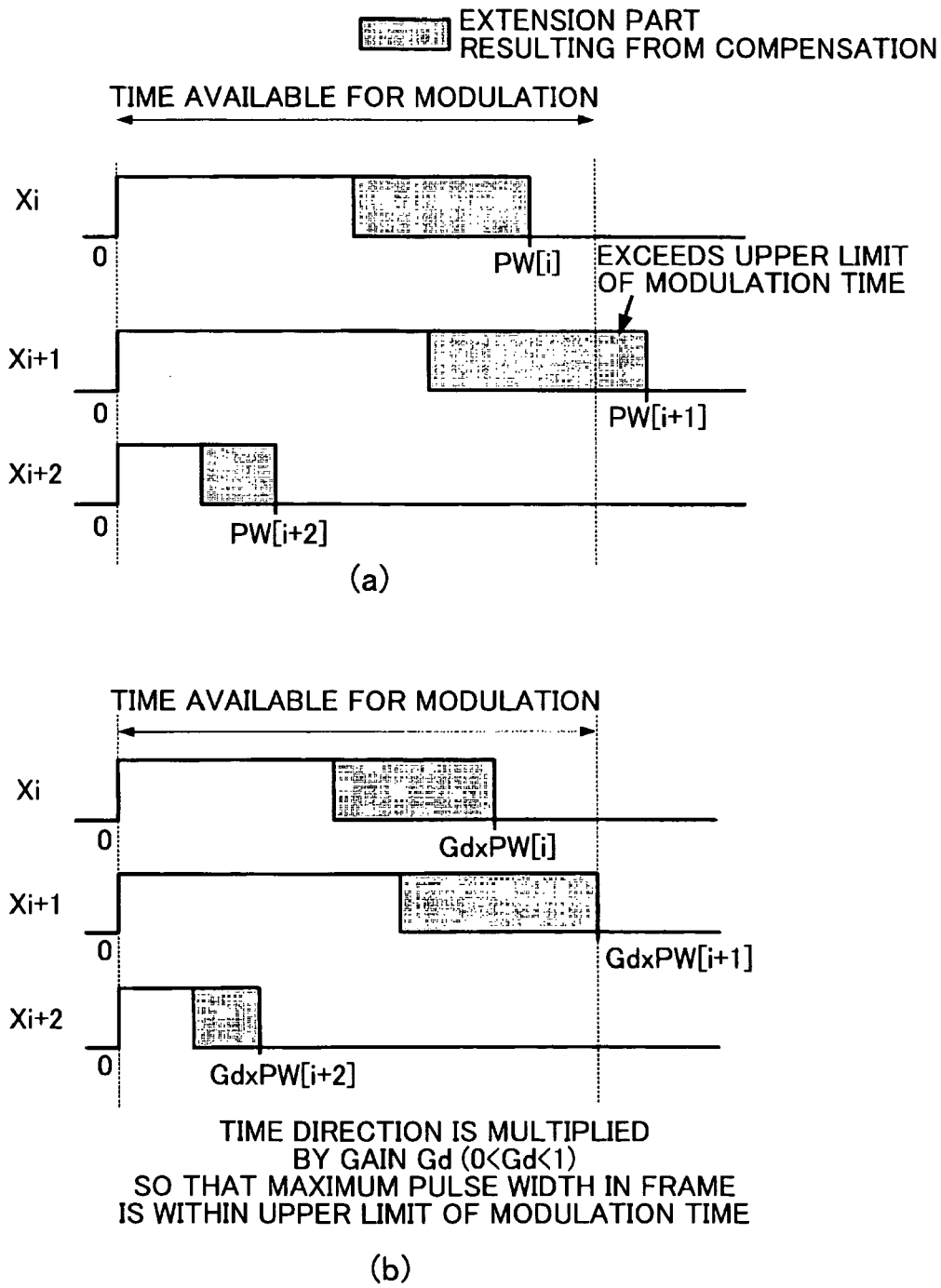
FIG. 5 is a view illustrating an overflow processing concept of the invention.

With respect to this problem, in this preferred embodiment, so that overflow does not occur, the time direction is compressed so that the greatest pulse width in the screen fits within the allocated modulation time. FIG. 5 is a view illustrating this processing for compressing the time direction. In the figures, the drive pulses (modulating means outputs) of certain modulation lines Xi, Xi+1, Xi+2 are shown schematically, the horizontal axis corresponding to pulse width (time) and the vertical axis showing drive pulse amplitude. And in the figure it has been supposed that, as a result of voltage drop compensation being carried out, the drive pulse widths to the modulation lines Xi, Xi+1, Xi+2 have respectively become PW[i], PW[i+1], PW[i+2] (FIG. 5(*a*)). (The areas shaded gray correspond to the parts where the drive pulse has been extended by compensation.) And it is supposed that of the drive pulses of one screen, the drive pulse width PW[i+1] of the modulation line Xi+1 is the maximum pulse width, and exceeds the upper limit of the modulation time.

Accordingly, in this example the time direction is compressed by all of the drive pulses being multiplied by a gain Gd so that the drive pulse of Xi+1 falls within the upper limit of the modulation time (FIG. 5(*b*)).

As a result, the pulse widths of the drive pulses to the modulation lines Xi, Xi+1, Xi+2 are compressed to Gd*PW[i], Gd*PW[i+1], Gd*PW[i+2].

As the method for calculating the gain Gd, assuming that there is a linear relationship between the pulse width and the input of the modulating means, and writing the largest modulation data (image data) that can be modulated as INMAX and the maximum value of the modulation data in one frame as MAX, then overflow can be prevented by calculating the gain Gd as:

$$Gd = \mathrm{INMAX}/\mathrm{MAX} \qquad \text{(Exp. 1)}$$

(To prevent overflow from occurring, the gain Gd should be made smaller than the right side of Exp. 1. And when the value of MAX is smaller than INMAX, the value of Gd may be limited to 1.)

When this is looked at in relation to the above-mentioned voltage drop compensation, it has the following meaning. That is, when a gain Gd is not applied, the pulse is extended so as to become the same as "the emitted charge quantity of when there is no voltage drop".

When on the other hand the gain Gd is applied, it can be thought of as the pulse being extended so as to result in the same charge quantity as "Gd times the emitted charge quantity of when there is no voltage drop".

(Phosphor Saturation Compensation and Voltage Drop Compensation)

It has been mentioned that the light emission characteristic (saturation characteristic) of a phosphor can be approximated to a single curve for each color with respect to emitted charge quantity (FIG. 3(*a*)).

Accordingly, the saturation characteristic of a phosphor can be compensated by, in short, using the inverse function of the characteristic shown in FIG. 3(*a*), i.e. that shown in FIG. 3(*b*), to compute the amount of charge that should be projected (emitted).

In FIG. 3(*b*), QR, QG and QB are the inverse functions of qr, qg and qb in FIG. 3(*a*).

And if data conceptually equivalent to this charge quantity is supplied to the voltage drop compensation portion as an input, because the pulse width is extended so that the charge quantity becomes the same as the input value, the voltage drop compensation can be carried out well.

However, it has also been mentioned that by overflow processing the drive pulse width is extended so as to achieve the same emitted charge quantity as Gd times the charge quantity of when there is no voltage drop.

Therefore, to make the light emission luminance of the phosphor linear with respect to the input image data (luminance demand values), it is desirable for compensation to be carried out by the following procedure. The input image data (luminance demand values) is converted to the emitted charge quantities needed to obtain luminances corresponding with those luminance demand values, with reference to the curves (correctly, inverse functions) of the light emission characteristics of the phosphors.

At this time the charge quantity that can actually be projected is limited by the gain after voltage drop compensation.

Therefore, the phosphor saturation is compensated taking into account the charge quantity that can be projected in accordance with the value of the gain.

When the gain Gd is 0.25, the charge quantity that can be emitted is limited to within the region shown with the lines marked Gd=0.25 in FIG. 3(*a*).

When the gain Gd is 0.5, the charge quantity that can be emitted is limited to within the region shown with the lines marked Gd=0.5 in FIG. 3(*a*).

And when the gain Gd is 1.0, the charge quantity that can be emitted is not limited and takes the range of the region shown with the lines marked Gd=1.0 in FIG. 3(*a*).

Figure 6:
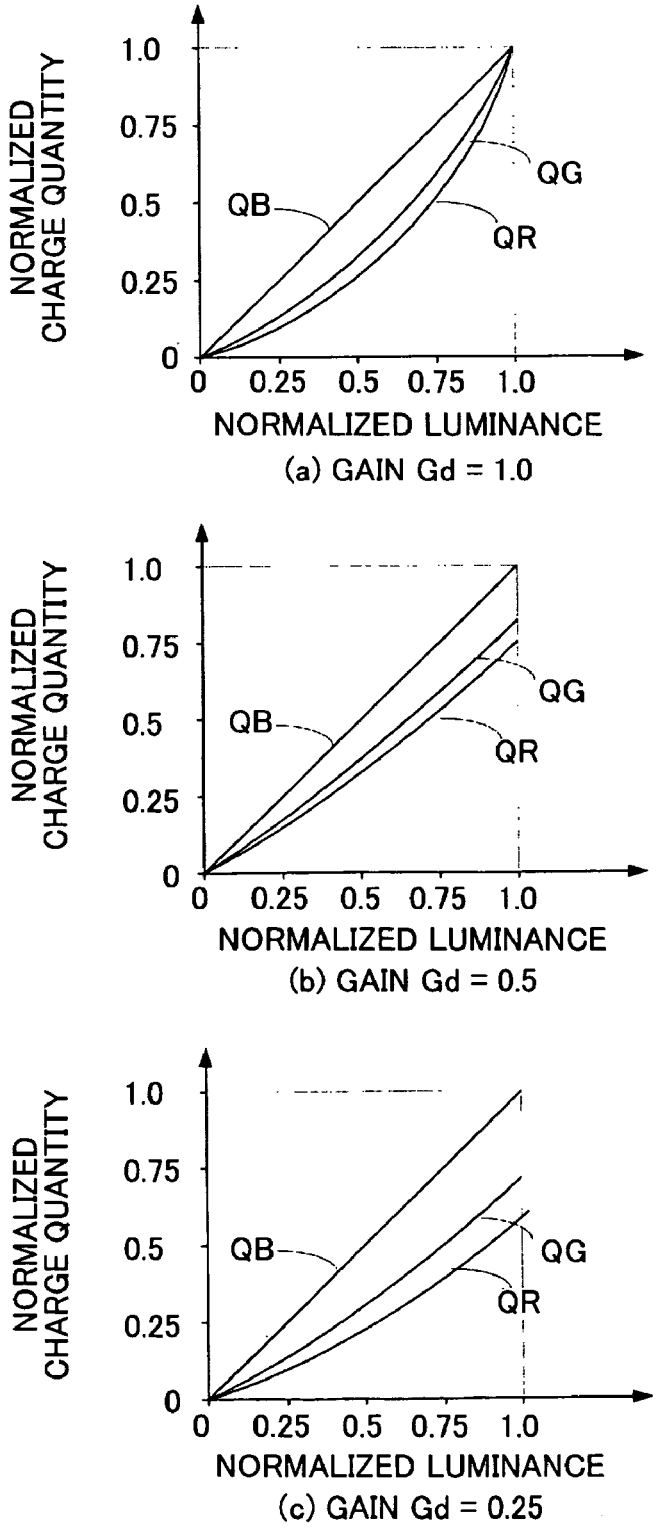
FIG. 6 is a view showing conversion tables for compensating phosphor saturation at different levels of gain.

Considering the above, with these as compensating characteristics, the input image data constituting the luminance demand values should be converted to charge quantities using the characteristic of FIG. 6(*a*) in the case of gain Gd=1, the characteristic of FIG. 6(*b*) in the case of gain Gd=0.5, and the characteristic of FIG. 6(*c*) in the case of gain Gd=0.25.

At this time, the input image data should be converted to charge quantity data in accordance with the curves of FIG. 6 with the maximum value that the input image data can take as 1. In practice the value of the gain can of course take values other than the three mentioned above, but in that case the saturation characteristics can be compensated by varying that area in accordance with the gain.

Although the value of the gain Gd is needed before the conversion is carried out, strictly speaking the value is not known until after the phosphor saturation compensation and voltage drop compensation.

A practical solution to this is to exploit the correlation of image data between frames and use the gain Gd of one frame earlier.

As a result of the voltage drop compensation the image data is compensated so that a charge quantity equivalent to the emitted charge quantity data is emitted, and the pulse widths of the drive pulses are modulated on the basis of the compensated image data.

When compensated image data was computed in the way described above and an image displayed with pulse widths of drive pulses being compensated accordingly, good results were obtained.

This ends a description of basic concepts of phosphor saturation compensation and voltage drop compensation.

Now, hardware made on the basis of the basic concepts explained above will be described (Description of Overall System and Functions of Parts)

Next, the construction of an image display apparatus according to this preferred embodiment will be described.

Figure 7A:
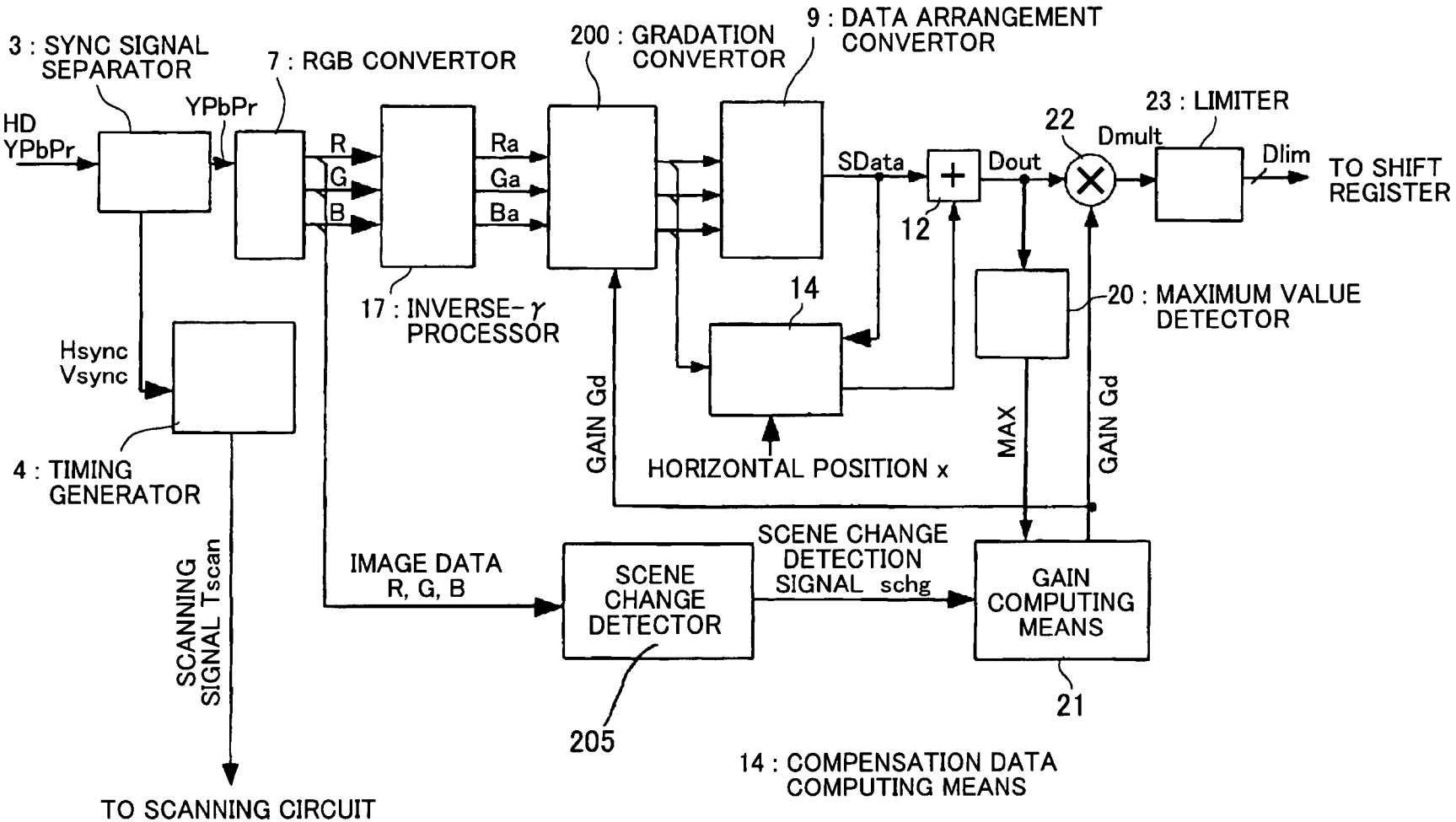
FIGS. 7A and 7B are block diagrams showing the outline construction of an image display apparatus of a first preferred embodiment.
Figure 7B:
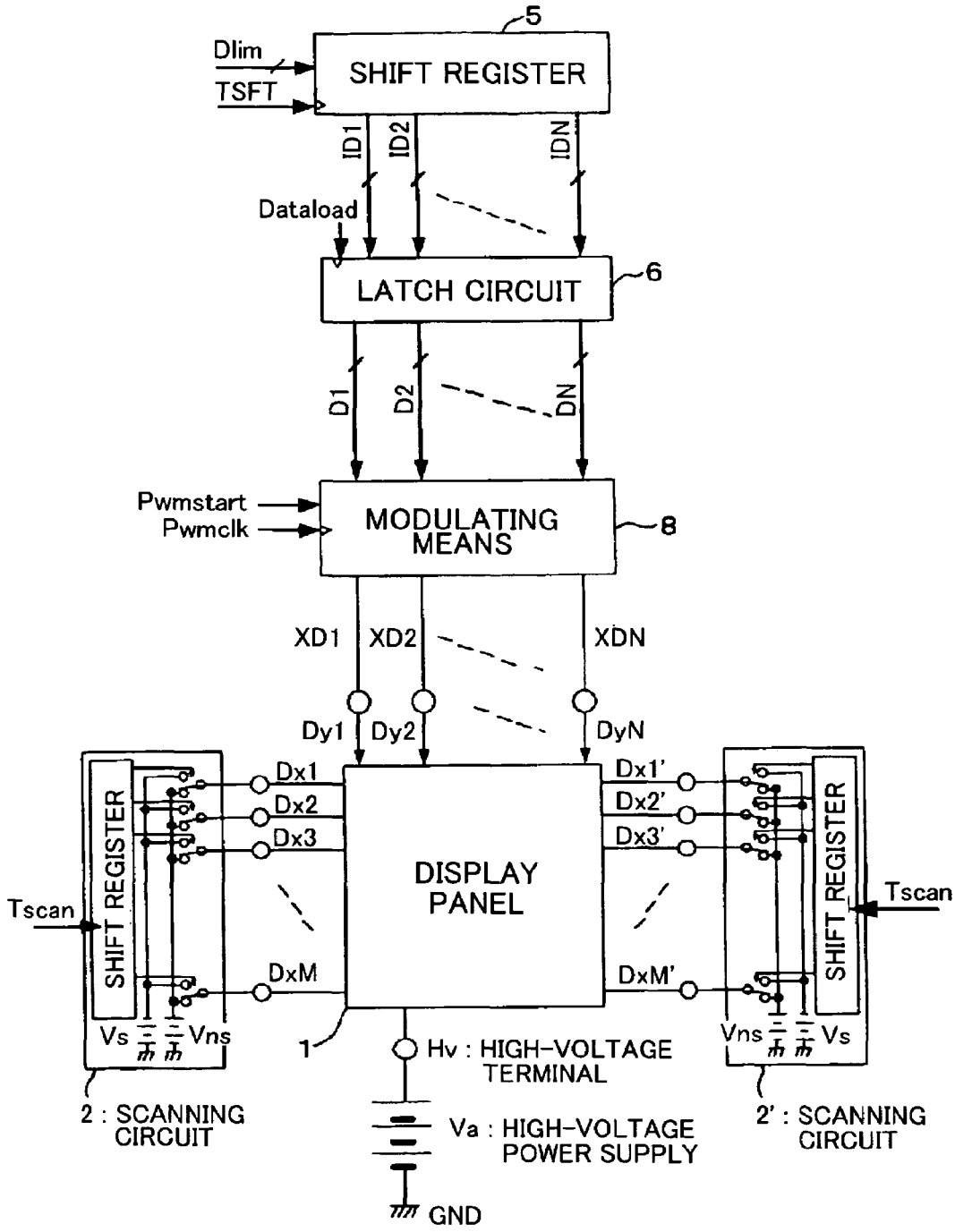

FIGS. 7A and 7B are block diagrams showing schematically the circuit construction of this image display apparatus. In the figures, the reference number 1 denotes a display panel; Dx1 to DxM and Dx1' to DxM' are voltage supply terminals of scan lines of the display panel; Dy1 to DyN are voltage supply terminals of modulation lines of the display panel; Hv is a high-voltage terminal for applying an acceleration voltage across a face plate and a rear plate; Va is a high-voltage power supply; 2 and 2' are scanning circuits; 3 is a synchronizing signal separator (synchronizing signal separation circuit); 4 is a timing generator (timing generation circuit); 7 is a RGB convertor for converting a YPbPr signal from the synchronizing signal separator 3 into RGB; 17 is an inverse-γ processor (inverse-γ processing portion); 5 is a shift register for one line of image data; 6 is a latch circuit for one line of image data; 8 is pulse width modulating means for outputting a modulated signal to the modulation lines of the display panel; 12 is an adder; 14 is compensation data computing means; 20 is a maximum value detector (maximum value detecting means); 21 is gain computing means; and 200 is a gradation convertor (gradation converting portion, phosphor saturation compensating portion).

The synchronizing signal separator 3 separates synchronizing signals Vsync and Hsync, and supplies them to the timing generator 4. A picture signal separated from the synchronizing signals is converted from YPbPr into RGB, undergoes low pass filtering and A/D conversion, and is converted into a digital RGB signal.

The timing generator 4 generates timing signals corresponding to the synchronizing signals and generates operation timing signals for different parts. These include a signal Tsft for controlling the operation timing of the shift register 5, a control signal Dataload for latching data from the shift register 5 to the latch circuit 6, a pulse width modulation start signal Pwmstart for the modulating means 8, a clock Pwmclk for pulse width modulation; and a signal Tscan for controlling the operation of the scanning circuits 2, 2'.

(Scanning Circuits)

The scanning circuits 2 and 2' are circuits for outputting a selection potential Vs or a deselection potential Vns to the connection terminals Dx1 to DxM and Dx1' to DxM' in order to scan sequentially the display panel 1 for one horizontal scan period by one row.

The scanning circuits 2 and 2' perform scanning by sequentially changing a scan line being selected every one horizontal period, in synchrony with the timing signal Tscan from the timing generator 4.

The scanning circuits 2 and 2' are made up of M switches and transistors and so on. These switches preferably consist of transistors or FETs.

(Inverse-γ Processor)

A CRT has a light emission luminance characteristic of approximately 2.2-power of the input. An ordinary input picture signal is generated to expect this characteristic of a CRT, and is generally converted in accordance with a γ characteristic of 0.45-power so as to have a linear light emission characteristic when displayed on a CRT.

In the display panel of this preferred embodiment, on the other hand, when pulse width modulation is carried out, because it has a substantially linear light emission characteristic with respect to application time, in the inverse-γ processor, conversion is carried out in accordance with a 2.2-power curve.

(Gradation Convertor)

Figure 8:
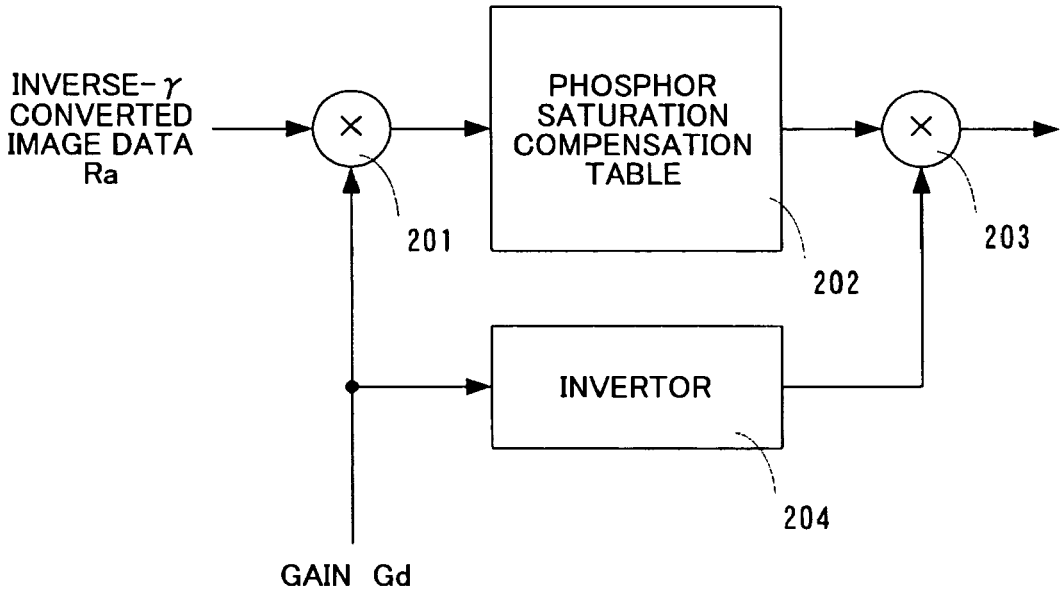
FIG. 8 is a block diagram showing a first construction example of a gradation convertor.

The gradation convertor (gradation converting means) 200 is means for converting inverse-γ-converted image data in accordance with phosphor saturation compensation tables (FIG. 8). In FIG. 8, the reference number 201 denotes a multiplier; 202 a phosphor saturation compensation table; 203 a multiplier; and 204 an invertor. Although in FIG. 8 only an Ra signal is shown, the gradation convertor has the construction shown in FIG. 8 for each color, and the different phosphor saturation characteristic of each color shown in FIG. 3(*b*) is stored in the respective phosphor saturation compensation table. In phosphor saturation compensation it is necessary for the region of the compensation table used to be changed in accordance with the value of the gain, as mentioned above; the multipliers 201, 203 and the invertor 204 perform this function.

The image data having undergone phosphor saturation compensation is fed to a data arrangement convertor (data arrangement converting portion) 9 and the compensation data computing means 14.

(Data Arrangement Convertor)

The data arrangement convertor 9 has the function of rearranging the inverse-γ-converted RGB parallel picture signal Ra, Ga, Ba into the pixel arrangement of the display panel.

When image data Ra, Ga, Ba of a certain horizontal scanning period is written to the data arrangement convertor 9, it is read out in the next horizontal scanning period.

The data read out is parallel/serial-converted in accordance with the pixel arrangement of the display panel by a selector, and outputted as RGB serial image data SData.

(Compensation Data Computing Means, Adder)

The compensation data computing means 14 is a circuit for computing voltage drop compensation data. The compensation data constituting its output is computed in accordance with the image data of pixels (horizontal position). A specific method for this calculation will be discussed later.

The adder 12 adds the compensation data CD from the compensation data computing means 14 to the image data SData. The image data SData is compensated by this addition being carried out and is fed to the maximum value detector 20 and the multiplier 22 as compensated image data Dout. Here, the compensation data computing means 14 and the adder 12, which adds together the compensation data CD and the image data SData to produce compensated image data Dout, constitute compensated image data computing means.

(Maximum Value Detector, Gain Computing Means)

The maximum value detector 20 is connected to respective parts as shown in FIG. 7A. That is, it inputs the compensated image data Dout outputted from the adder 12 and outputs a maximum value MAX to the gain computing means 21.

The maximum value detector 20 detects the maximum value in the compensated image data Dout of one frame.

The gain computing means 21 is means for computing a gain for performing the overflow processing described above. Amplitude regulating means is included in the gain computing means 21 and the multiplier 22.

Here, two gain computing methods will be described.

In the first method, the gain is computed using Exp. 1.

In this case, a gain value is computed for each frame.

Figure 9:
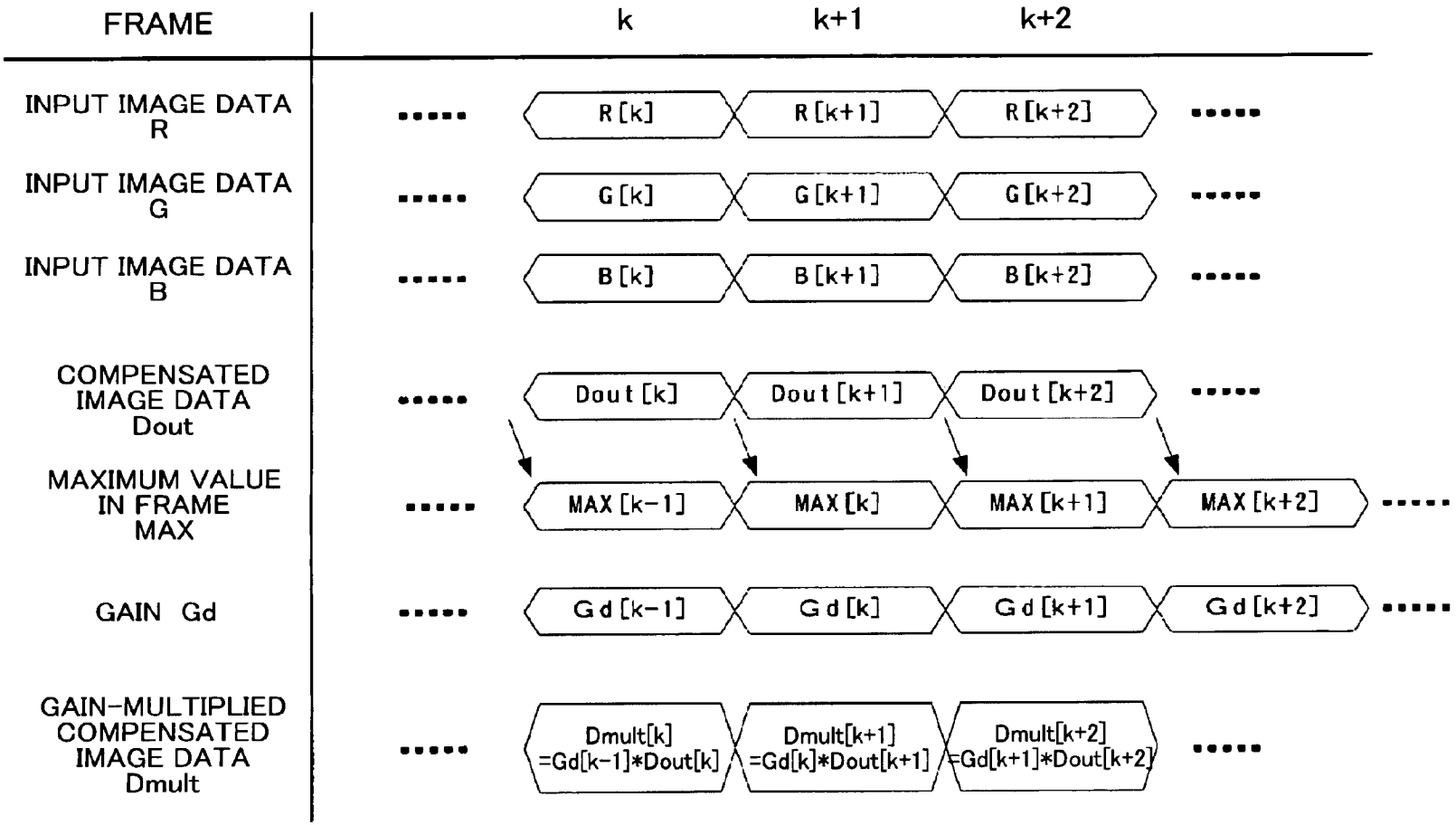
FIG. 9 is a view illustrating a relationship between data and gain with respect to each frame in the first preferred embodiment.

FIG. 9 is a timing chart showing the relationship between image data, compensated image data and gain for each frame. In the figure, R[k], G[k], B[k] are sets of image data inputted to the kth frame, and Dout[k] is the set of compensated image data computed with respect to the image data of the kth frame. MAX[k] is the maximum value in Dout[k], and Gd[k] is the gain computed from MAX[k]. Dmult[k] is the compensated image data after gain multiplication.

$$Dmult[k]=Dout[k]*Gd[k-1] \quad \text{(Exp. 2)}$$

Because in this construction the value of the gain Gd[k] is computed with a lag of 1 frame, overflow may occur due to different compensated image data for each frame.

With respect to this issue, preferably, a limiter circuit (limit means) 23, which will be further discussed later, is provided for limiting the output Dmult of the multiplier 22 obtained by multiplying the compensated image data Dout by the gain Gd, and the circuit is designed so that the output of the multiplier 22 remains within the input range of the modulating means 8 (FIG. 7A).

(If a frame memory is provided between the maximum value detector 20 and the multiplier 22, overflow can be prevented by means of a construction wherein there is no time lag.)

Next, a second gain computing method will be described.

In this second method, writing the gain to be applied to the image data of the kth frame calculated using Exp. 1 as Gn[k], the gain Gd[k] is computed as follows:

$$Gd[k]=a*Gn[k]+(1-a)*Gd[k-1] \quad \text{(Exp. 3)}$$

where a is a constant in the range $0<a<1$.

As the value of the constant a, preferably a value of ¼ to 1/64 is used.

Here, the method of computing the gain Gd[k] using Exp. 3 is to compute it by means of a filter inputting Gn[k] and outputting Gd[k]. That is, the gain computing means 21 has the function of filtering means for carrying out this processing. A filter satisfying a difference equation like Exp. 3 is a so-called low pass filter, and the smaller is a the stronger is the filter.

This second method is superior in that when chronological fluctuations in the gain are large, flicker can be reduced.

Figure 10:
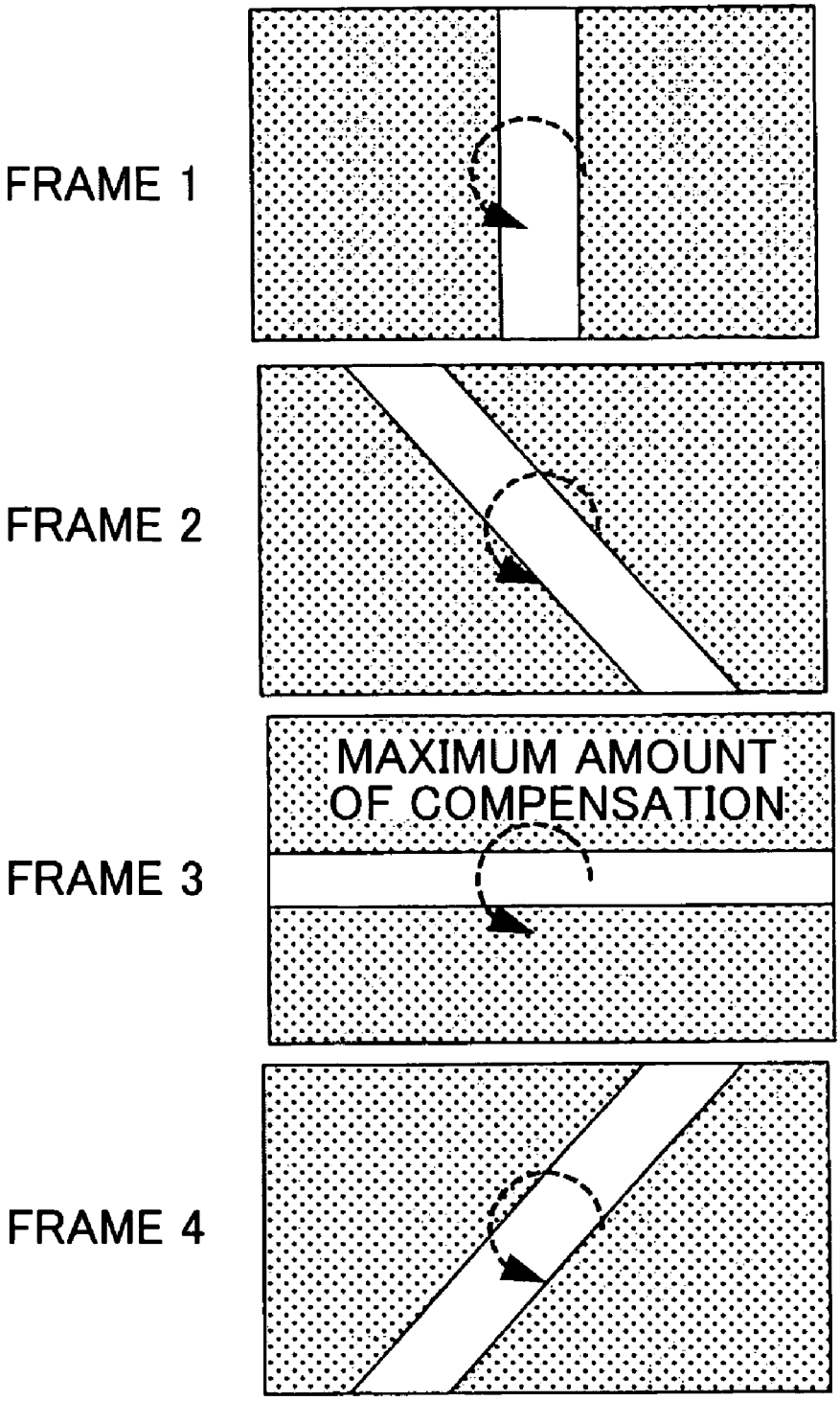
FIG. 10 is a view showing an example of a moving picture in successive frames.
Figure 11:
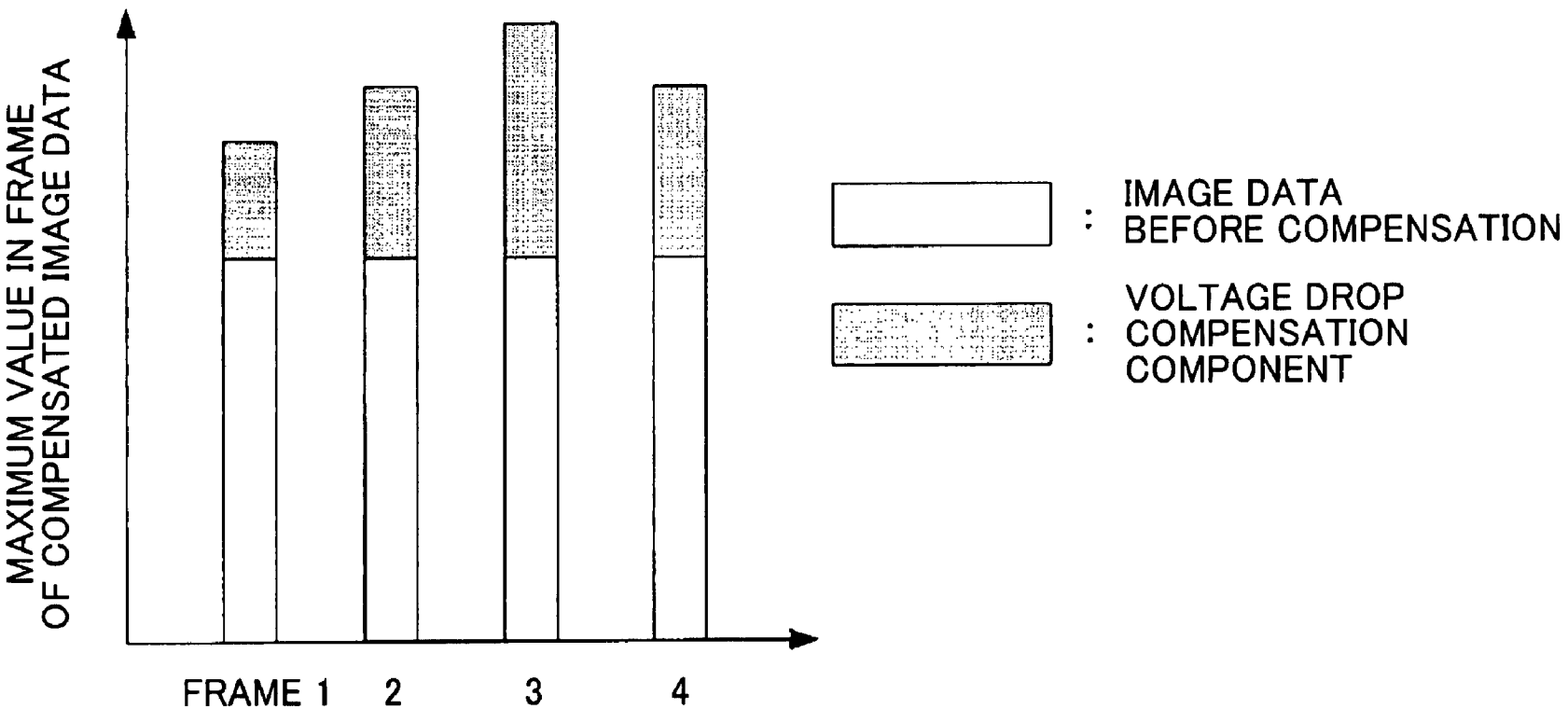
FIG. 11 is a graph showing values of compensated image data in successive frames.
Figure 12:
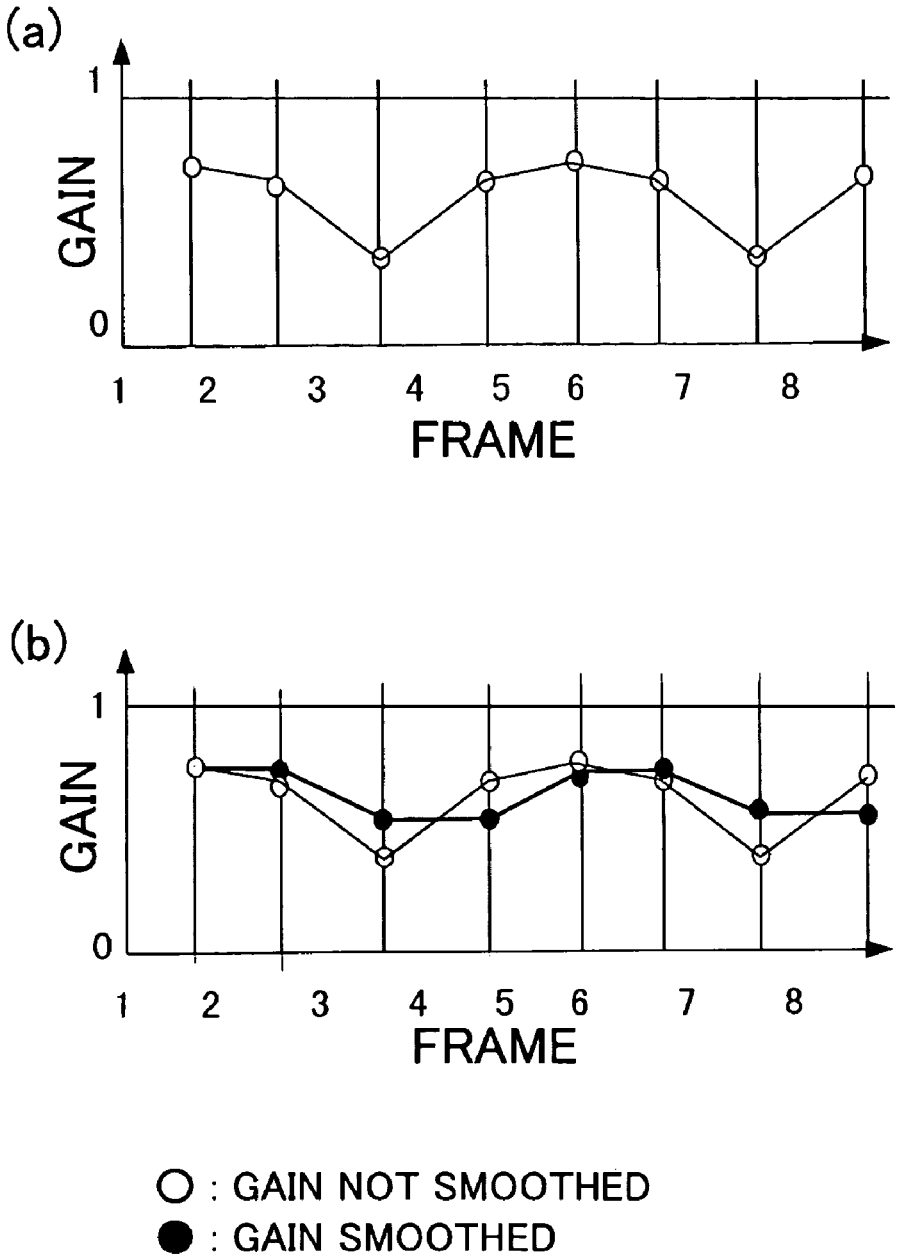
FIG. 12 is a graph showing gains in successive frames.

FIG. 10 through FIG. 12 are views illustrating the merits of the second method.

FIG. 10 is an example of a moving picture in which a white bar is rotating counterclockwise against a gray background. When displaying an image like this, the size of the compensation data CD changes from frame to frame as the bar rotates.

FIG. 11 is a view illustrating maximum values of the compensated image data of the moving picture of FIG. 10. FIG. 11 shows the maximum value of the compensated image data of each frame as a bar in a chart.

The unshaded areas of the chart of FIG. 11 correspond to the original image data, and the gray areas correspond to parts which have been added as a result of compensation being carried out. The maximum value of the compensated image data of successive frames fluctuates with time. Therefore, when the gain is set frame by frame as shown by Exp. 1, the fluctuation of the gain from frame to frame is severe, as shown in FIG. 12(*a*), and consequently luminance fluctuations in the displayed image become severe and there is a sense of flicker. With respect to this, when the gain is determined using Exp. 3, fluctuation of the gain with time is suppressed, and consequently, as shown in FIG. 12(*b*), there is the highly desirable effect that gain fluctuations are small, luminance fluctuations are small, and sense of flicker is reduced as a result. In FIG. 12(*b*), the plot shown with white dots is the gain obtained using Exp. 1, and the plot shown with black dots is the smoothed gain obtained using Exp. 3.

Accordingly, in this preferred embodiment, gain was computed in accordance with the second method.

(Multiplier, Limiter Circuit)

The gain Gd computed by the gain computing means 21 and the compensated image data Dout, which is the output of the adder 12, are multiplied by the multiplier 22 of FIG. 7A and fed to the limiter circuit 23 as amplitude-regulated compensated image data Dmult.

The limiter circuit 23 has a limit value preset corresponding to the upper limit of the input range of the modulating means 8, and with respect to inputs of values above the limit value limits its output to the limit value.

(Shift Register, Latch Circuit, Modulating Means)

The compensated image data Dlim limited by the limiter circuit 23 is serial/parallel-converted by the shift register 5 from a serial data format into parallel image data ID1 to IDN corresponding to the modulation lines, and outputted to the latch circuit 6. In the latch circuit 6, immediately before a horizontal period starts, on the basis of a timing signal Dataload, the data from the shift register 5 is latched. The output of the latch circuit 6 is supplied to the modulating means 8 as parallel image data D1 to DN.

In this preferred embodiment the image data ID1 to IDN, D1 to DN were made 8-bit image data. These operations are carried out on the basis of the timing control signals TSFT and Dataload from the timing generator 4.

The parallel image data D1 to DN constituting the output of the latch circuit 6 is supplied to the modulating means 8.

Figure 13A:
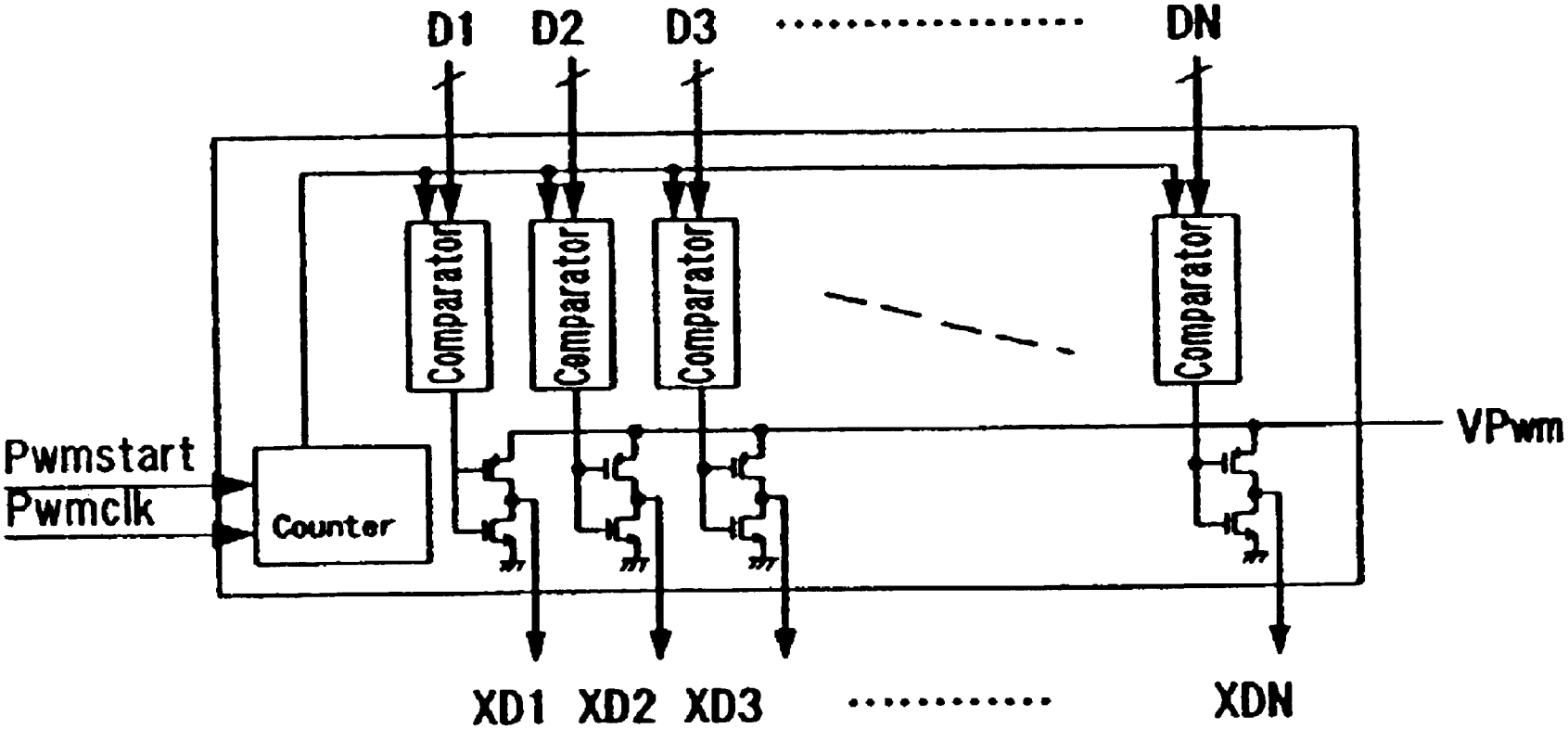
FIGS. 13A through 13C are views illustrating the construction and operation of modulating means of the image display apparatus.

As shown in FIG. 13A, the modulating means 8 is a pulse width modulating circuit (PWM circuit) having a PMW counter and a comparator and a switch (in the figure, a FET) for each of the modulation lines.

Figure 13B:
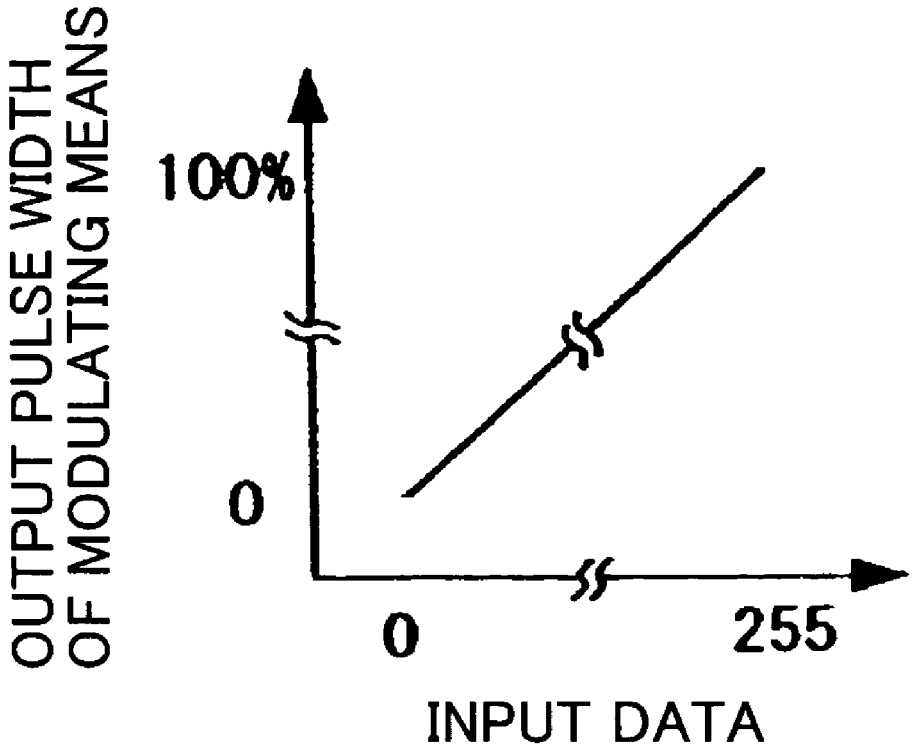

The relationship between the image data D1 to DN and the output pulse width of the modulating means 8 is a linear relationship of the kind shown in FIG. 13B.

Figure 13C:
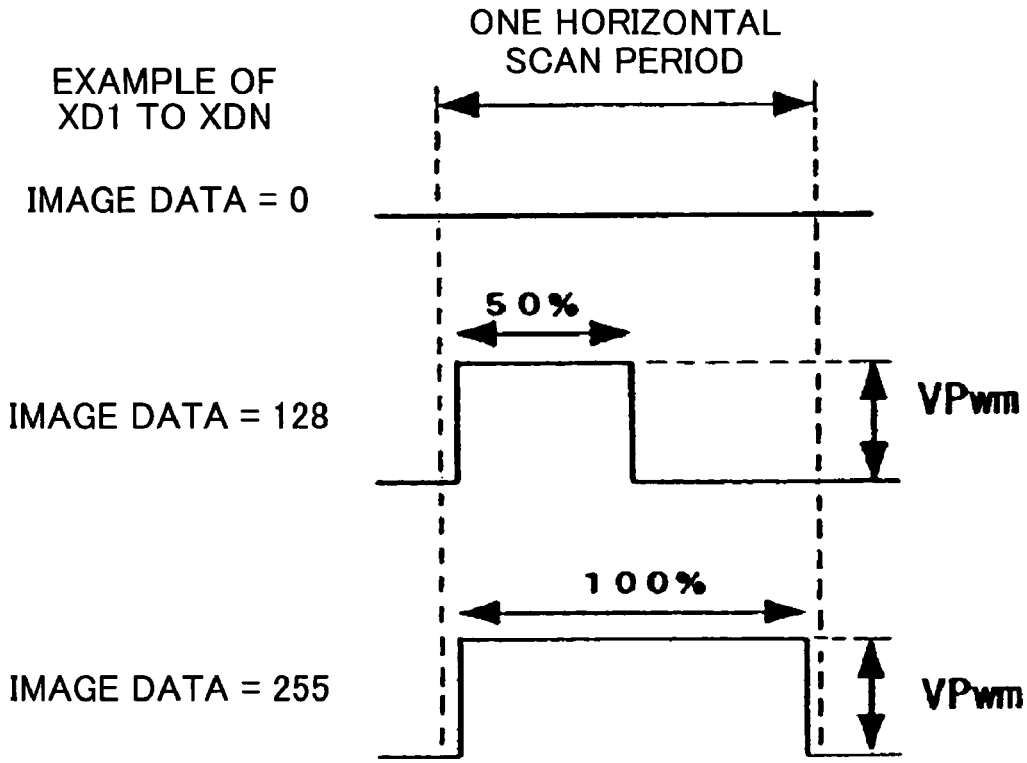

Three examples of output waveforms of the modulating means 8 are shown in FIG. 13C.

In the figure, the upper waveform is the waveform of when the input data to the modulating means 8 is 0; the middle waveform is the waveform of when the input data to the modulating means 8 is 128; and the lower waveform is the waveform of when the input data to the modulating means 8 is 255.

In this example the number of bits in each of the data D1 to DN input to the modulating means 8 is eight.

(Control on Scene Changes)

An image display apparatus provided with a processing circuit for compensating the affects of phosphor saturation and voltage drop which the inventors have been studying has been described above. When compensation was carried out by means of this image display apparatus, images were displayed well.

On the other hand, although the gain control described above suppresses screen flicker, when a scene change occurs in an inputted moving picture, because fluctuation with time of the gain is being suppressed, a different incongruity occurs due to the gain not being changed rapidly but rather changing gently.

For example, when there is a scene change from an image of which the average level of the input image data is high (bright) to an image of a different scene with a low average level (dark), the value of the gain determined from Exp. 1 must be changed swiftly from a small value to a large value.

However, in practice, because the gain changes from a small value to a large value gently with time, incongruity occurs. To overcome this, the inventors effected an improvement in this phenomenon by adding the novel control described below.

(Operation of Gain Computing Means 21 on Scene Change)

In this preferred embodiment, a scene change detector (scene change detecting portion) 205 for determining when there has been a scene change is provided (FIG. 7A).

In the scene change detector 205, supposing that the present frame is the kth frame, and writing the average level of the image data of the present frame as APL[k], ΔAPL [k+1] is calculated as follows:

$$\Delta APL[k+1]=|APL[k+1]-APL[k]| \quad \text{(Exp. 4)}$$

where || denotes absolute value.

The value of ΔAPL is then compared with a preset threshold value TH, and scene change detection carried out on the following basis:

If ΔAPL>TH, there has been a scene change.

If ΔAPL≦TH, there has not been a scene change. (Exp. 5)

The scene change detector 205 supplies a scene change detection signal schg to the gain computing means 21 (FIG. 7A).

The gain computing means 21 calculates a gain in accordance with the scene change as follows:

$$Gd[k+1]=Gn[k+1]\text{(scene change)}$$

$$Gd[k+1]=a*Gn[k+1]+(1-a)*Gd[k]\text{(no scene change)} \quad \text{(Exp. 6)}$$

where a is a constant in the range 0<a<1.

In this way, when the gain Gd[k+1] has been calculated, when there has been a scene change it is rapidly updated to a gain of after the scene change, and when there has not been a scene change, chronological fluctuations in the gain are made smooth. As a result, a good image can be displayed.

In the method of Exp. 6, gain smoothing is not carried out at the time of a scene change; however, the same effect can alternatively be obtained by using the no scene change case of Exp. 6 even when there has been a scene change, but making the coefficient a in this expression larger (that is, making the strength of the smoothing filter weaker).

(Gain Control on Scene Change)

When they investigated further how the input-output characteristic of the gradation convertor (phosphor saturation compensating portion) 200 changes with the gain, the inventors ascertained that it is desirable for the gain to be computed as follows.

When a scene change has occurred, when the gain changes greatly, the conversion characteristic of the gradation convertor (phosphor saturation compensating portion) 200 also changes. When this happens, because the size of the image data outputted by the gradation convertor 200 also changes, as a result, the gain calculated using Exp. 1 also changes greatly. However, because with the computation method of Exp. 6 from the next frame after a scene change gain fluctuation is suppressed by the filter, further improvement of gain control at times of scene change was necessary.

With respect to this problem, the inventors found that a more desirable effect can be obtained by not filtering the gain, or by making the filter coefficient a large (weakening the strength of the filter), for several frames after a scene change. As for the meaning of several frames, about 2 to 5 frames was optimal.

When the gain was controlled like this, after a scene change there was a rapid shift to a new gain, and when there was no scene change there was an effect of making the chronological fluctuation of the gain smooth, and images could be displayed well.

(Other Gain Calculating Method 1)

As another gain calculating method, the following method can be used. The range over which the gain can change generally can be determined in advance once the characteristics of the display panel have been decided. Accordingly, it was also satisfactory to perform the filter processing described above when there is no scene change and for the several frames immediately after a scene change to set the gain to a commonly taken value in its change range, for example to a middle value in the change range.

(Other Gain Calculating Method 2)

Another method for calculating the gain is as follows:

Whereas in Exp. 4 and Exp. 5 scene change determination is carried out from the difference in the absolute values of APL values between frames, considering that in an ordinary image there is a correlation between the gain value and the APL value, it is also possible to infer a value of gain on the basis of the APL value and use this inferred gain. As the gain of immediately after a scene change, it was satisfactory to set the present gain to a largish commonly taken value (for example a value intermediate between the present gain value and the maximum value (=1)) when the APL value had become small, and to set the present gain to a smallish commonly taken value (for example a value intermediate between the present gain value and the minimum gain value (Gmin: gain when the whole display is white)) when the APL value had become large.

It was also satisfactory to use:

$$Gd[k+1]=(1+Gn[k+1])/2\text{(scene change and } APL[k+1]<APL[k]\text{)}$$

$$Gd[k+1]=(Gmin+Gn[k+1])/2\text{(scene change and } APL[k+1]>APL[k]\text{)}$$

$$Gd[k+1]=a*Gn[k+1]+(1-a)*Gd[k]\text{(no scene change)} \quad \text{(Exp. 7)}$$

And, as the value of the gain, it is also satisfactory to set it to an intermediate value weighted by the change in the APL value.

This concludes the description of gain control methods.

A calculating method for the voltage drop compensating part (compensation data calculating means) will now be described.

(Voltage Drop Calculating Method)

To obtain compensation quantities for reducing the affect of voltage drop, first, as a first step, it is necessary to predict in real time the size of the voltage drop and its time change; however, the display panel of an image display apparatus generally has several thousand modulation lines, and to calculate the voltage drop at the intersections of all the modulation lines with the scanned line is very difficult and to calculate this in real time would require some very large hardware.

To overcome this, the amount of calculation is reduced by blocking being carried out in relation to positions on the same row and blocking being carried out in the amplitude direction of the image data to obtain voltage drop levels.

The method of this blocking is based on the following characteristics of voltage drop.

i) At a given time in a horizontal scan period, the voltage drop occurring on the scanned line is a spatially continuous quantity on the scanned line and is a very smooth curve.

ii) Although the size of the voltage drop also varies with the displayed image, it changes at intervals equivalent to one gradation of pulse width modulation, and roughly it is greatest near the rise part of the pulse and then either gradually becomes smaller with time or maintains its size.

That is, with a drive method of the kind shown in FIG. 2, the size of the voltage drop does not increase within the horizontal scan period.

Specifically, the change with time of the voltage drop is predicted approximately by carrying out voltage drop calculations based on a degradation model explained below for a number of points in time.

(Calculation of Voltage Drop Using Degradation Model)

Figure 14A:
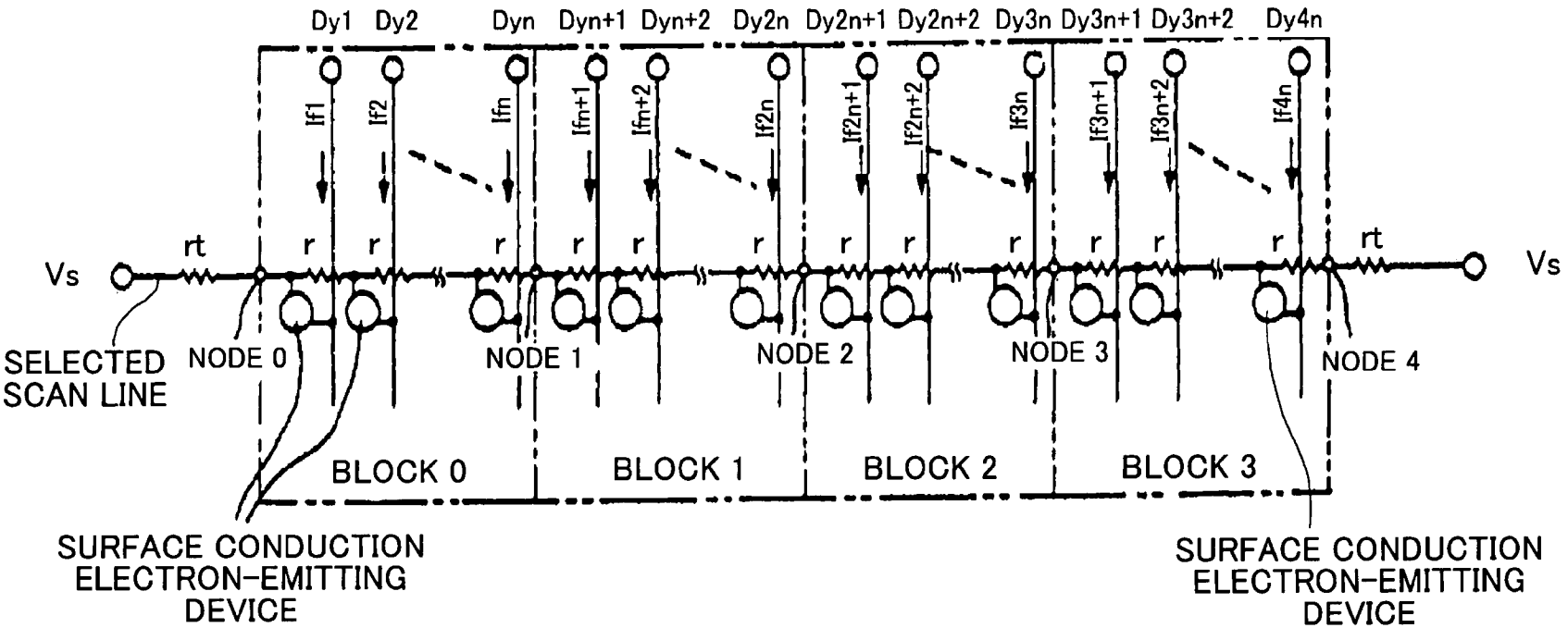
FIGS. 14A through 14C are views illustrating a degeneration model.

FIG. 14A is a view illustrating blocks and nodes in performing a degradation.

In the figure, to simplify the drawing, only a selected scan line and some modulation lines and the surface conduction electron-emitting devices connected at their intersections are shown.

It will be supposed that the time is now within a horizontal scan period, and the lit/unlit states of the pixels on the selected scan line (that is, whether the output of the modulating means is 'H' or 'L') are known.

In this lighting state, the device currents flowing into the selected scan line from the modulation lines will be defined as Ifi (i=1, 2, . . . N, i being the column number).

And, as shown in the figure, blocks are defined with n modulation lines and the parts of the selected scan line intersecting with them and the surface conduction electron-emitting devices disposed at those intersections as one group. In this example, by performing block division, four blocks have been created.

And, positions called nodes are set at the boundary positions of the blocks. Nodes are horizontal positions (reference points) for discretely calculating voltage drops occurring on the scan line in the degradation model.

In this example, five nodes, node 0 to node 4, are set at the boundary positions of the blocks.

Figure 14B:
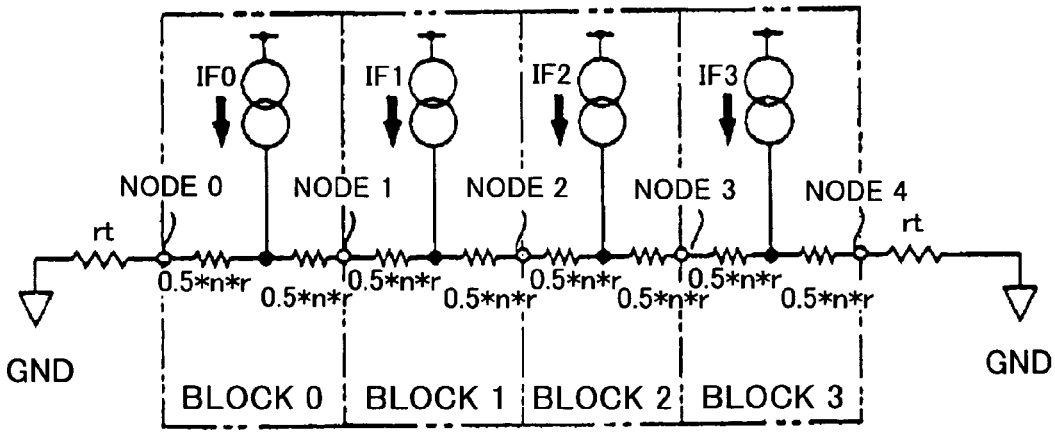

FIG. 14B is a view for explaining the degradation model.

In the degradation model, the n modulation lines included in one block in FIG. 14A are degraded to one line, and the degraded one modulation line is connected to the center position of the scan line in the block.

A current source is connected to the modulation line of each degraded block, and the totals IF0 to IF3 of the currents in the blocks are assumed to flow from these current sources.

That is, IFj (j=0, 1, . . . 3) are currents expressed as:

$$IFj = \sum_{i=j\times n+1}^{(j+1)\times n} Ifi \qquad \text{(Exp. 8)}$$

And, whereas in the example in FIG. 14A the potentials at the ends of the scan line are Vs, in FIG. 14B they are GND because in the degradation model, as a result of the currents flowing from the modulation lines into the selected scan line being modelled as the current sources, the voltage drops of different parts on the scan line can be calculated by computing the voltages (potential differences) of the parts with the supply parts as reference (GND) potentials.

That is, they are set as reference potentials in computing voltage drops.

The reason why the surface conduction electron-emitting devices have been omitted is that when seen from the selected scan line, if the same currents flow in from the modulation lines, the occurring voltage drops themselves are the same, irrespective of whether or not the surface conduction electron-emitting devices are present. Accordingly, here, the surface conduction electron-emitting devices are omitted by the current values flowing in from the current sources of the blocks being set to the total current value of the device currents in the blocks (Exp. 8).

And, the line resistance of the scan line in each block was assumed to be n times the line resistance r of the scan line of one section (here, one section means from the intersection of the scan line with one modulation line to the intersection with the next modulation line; and in this example, the line resistance of the scan line in one section is assumed to be the same in all the sections).

In this kind of degradation model, the voltage drops DV0 to DV4 occurring at the nodes of the scan line can be calculated easily using:

$$DVi = \sum_{j=0}^{3} aij \times IFj \ (i = 0, 1, 2, 3, 4) \qquad \text{(Exp. 9)}$$

Here, aij is the voltage arising at the ith node when unit current flows into only the jth block in the degradation model (hereinafter this is defined as aij).

Results of calculating aij once can be stored as a table.

Also, with respect to the total currents IF0 to IF3 of the blocks given by Exp. 8, an approximation of the kind shown by Exp. 10 is carried out:

$$IFj = \sum_{i=j\times n+1}^{(j+1)\times n} Ifi = IFS \times \sum_{i=j\times n+1}^{(j+1)\times n} \text{Count } i \qquad \text{(Exp. 10)}$$

In Exp. 10 Count i is a variable taking the value 1 when the ith pixel of the selected scan line is lit and taking the value 0 when it is not lit.

IFS is a quantity obtained by multiplying the device current IF which flows when the voltage VSEL is applied to the terminals of one surface conduction electron-emitting device by a coefficient α taking a value from 0 to 1.

That is, $$IFS = \alpha \times IF \qquad \text{(Exp. 11)}$$

In Exp. 10, it is being assumed that from the modulation lines of each block a device current proportional to the number of lit devices in the block flows into the selected scan line. The reason for taking the device current IF of one device multiplied by a coefficient α as the device current IFS of one device here is as follows. Strictly, to calculate voltage drops, it is necessary to repeatedly calculate voltage rises of the scan line caused by voltage drop and the consequent device current reductions; but to perform this convergence calculation with hardware is not realistic. So, in this preferred embodiment, αIF is used as an approximation to the converged value of IF. Specifically, the percentage fall in IF (=α1) of when the voltage drop is maximum (when all white) and the percentage fall in IF (α=2) of when the voltage drop is minimum (=0) are estimated in advance, and the coefficient $\alpha$ is obtained as the average of $\alpha 1$ and $\alpha 2$ or as $0.8 \times \alpha 1$.

Figure 14C:
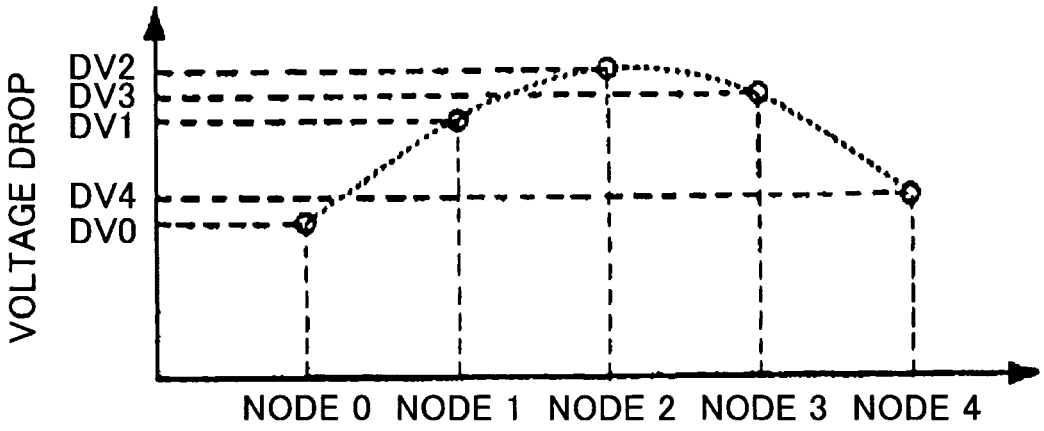

FIG. 14C is an example of the result of calculating the voltage drops DV0 to DV4 of the nodes using the degradation model, in a certain lighting state.

Because the voltage drop forms a very smooth curve, voltage drops between nodes can be expected to take approximately the sort of values shown with a dotted line in the graph.

Thus, by using this degradation model, it is possible to calculate voltage drops at the positions of nodes at a designated time with respect to inputted image data.

Above, voltage drops in a certain lighting state were calculated simply using a degradation model.

Voltage drops arising on the selected scan line change with time within the horizontal scan period, and for this as described above at a number of times within each horizontal scan period the lighting state at that time was obtained and using the degradation model with respect to that lighting state the voltage drop was predicted by calculation.

The lit number in a block at a certain time in the horizontal scan period can be obtained simply by referring to the image data of the block.

Now, as an example it will be assumed that the data inputted to the pulse width modulation circuit is 8-bit and that the pulse width modulation circuit outputs a pulse width corresponding to the value of the input data.

That is, it will be supposed that when the input data is 0, the output is 'L', when the input data is 255 the output over the horizontal scan period is 'H', and when the input data is 128 the output is 'H' for the first half of the horizontal scan period and 'L' is outputted for the second half of the period.

In this kind of case, the lit number at the start time of the pulse width modulation signal (in the example of this modulated signal, the rise time) can be detected simply by counting the number of devices for which the input data to the pulse width modulation circuit is greater than 0.

Similarly the lit number at the middle time of the horizontal scan period can be detected simply by counting the number of devices for which the input data to the pulse width modulation circuit is greater than 128.

By comparing the image data with a certain threshold value like this and counting the number for which the output of the comparator is true, it is possible to calculate simply the lit number at any time.

Here, to simplify the following description, a quantity of time called a time slot will be defined.

That is, a time slot will be defined as expressing the time within a horizontal scan period from the rise of a pulse width modulation signal, time slot=0 expressing the time immediately after the start time of the pulse width modulation signal.

Time slot=64 will be defined as expressing the time at which a time equivalent to 64 gradations has elapsed from the start time of the pulse width modulation signal.

Here, an example has been shown of pulse width modulation wherein with the rise time as a reference the pulse width from there is modulated, but a case wherein the pulse width is modulated from the fall time as a reference can also be considered in the same way, albeit that the time axis progress direction and the time slot progress direction become opposite.

(Calculation of Compensation Data from Voltage Drops)

By performing repeat calculation using a degradation model as described above it was possible to approximately and discretely calculate the change with time of voltage drop in a horizontal scan period.

Figure 15:
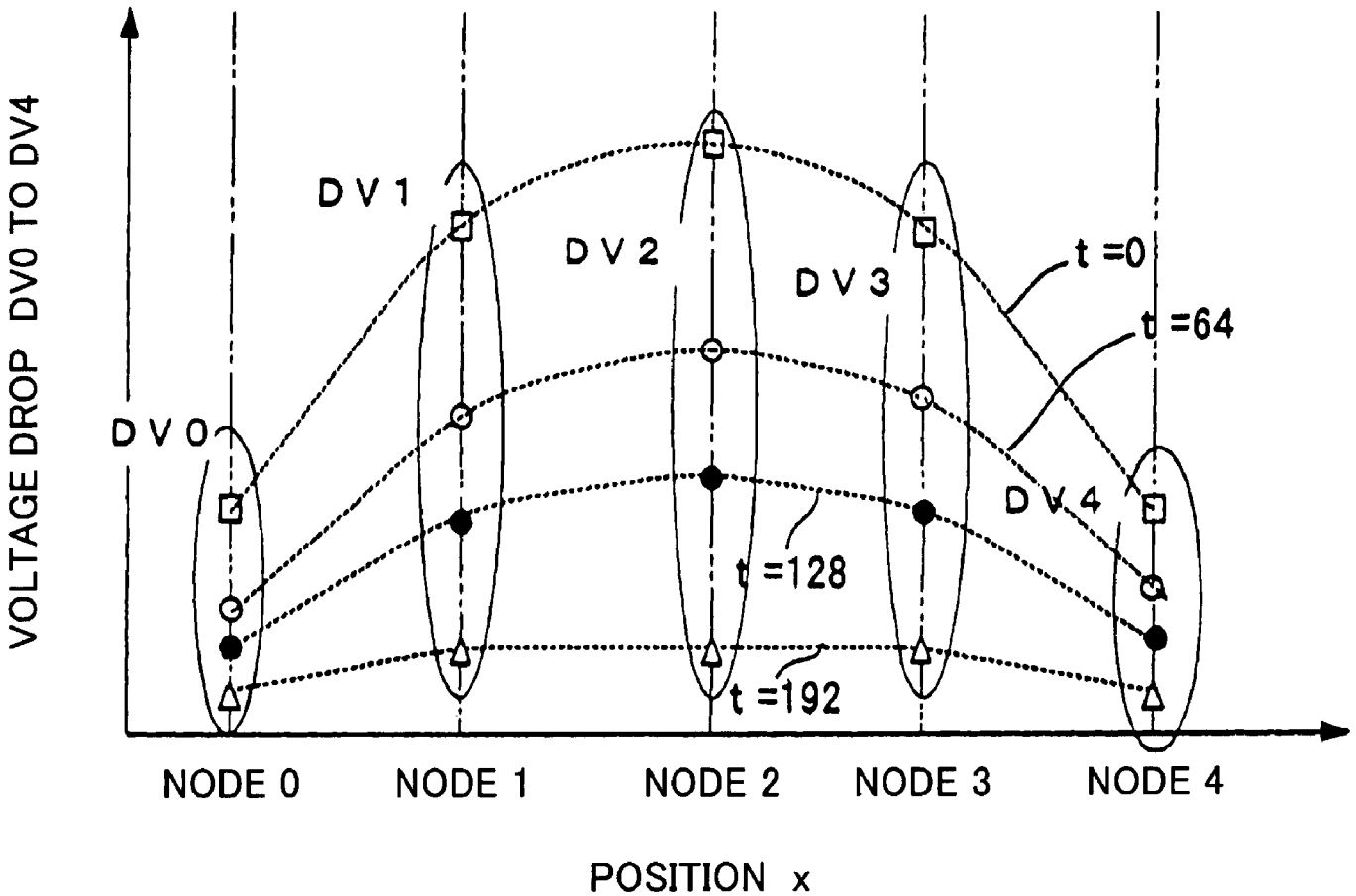
FIG. 15 is a graph showing discretely computed voltage drops.

FIG. 15 shows an example of change with time of voltage drop in a scan line calculated by repeat calculation of voltage drop with respect to certain image data (the voltage drop and change with time thereof here are an example pertaining to certain image data, and naturally a voltage drop pertaining to different image data would change differently).

In this figure, by performing a calculation applying a degradation model with respect to each of the four time points of time slot=0, 64, 128 and 192, voltage drops at the respective times have been obtained discretely.

In FIG. 15 the voltage drops at the nodes have been joined with dotted lines, but the dotted lines are merely to make the chart easier to view; the voltage drops calculated by this degradation model were calculated discretely at the positions of the nodes shown with the white squares, the white dots, the black dots and the white triangles.

As a next stage after it becoming possible to calculate the size and change with time of voltage drop, the inventors studied methods of calculating compensation data for compensating the image data from the voltage drops.

Figure 16:
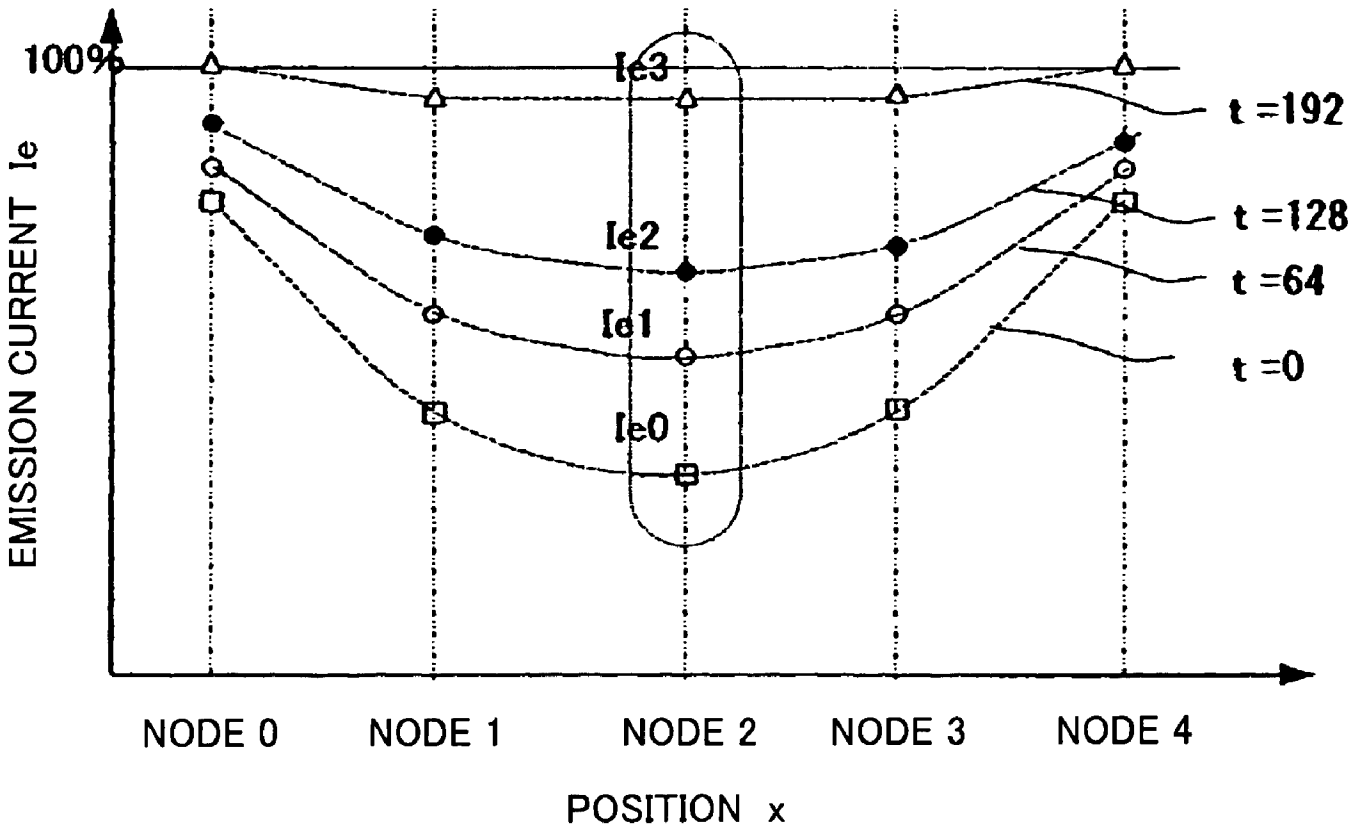
FIG. 16 is a graph showing discretely computed changes of emission current.

FIG. 16 is a graph obtained by estimating the emission currents emitted from the surface conduction electron-emitting devices in the lit state when the voltage drop shown in FIG. 15 has occurred in the selected scan line.

The vertical axis shows the emission current level as a percentage at each time and position with the size of the emission current emitted when there is no voltage drop as 100%, and the horizontal axis shows horizontal position.

As shown in FIG. 16, at the horizontal position of node 2 (reference point), the emission current at time slot=0 will be written Ie0; the emission current at time slot=64 will be written Ie1; the emission current at time slot=128 will be written Ie2; and the emission current at time slot=192 will be written Ie3.

FIG. 16 was calculated from the voltage drops shown in FIG. 15 and the graph of 'drive voltage vs. emission current' of FIG. 1. Specifically, the emission current values of when voltages obtained by subtracting the voltage drop from the voltage VSEL were applied were plotted mechanically.

Accordingly, FIG. 16 only means currents emitted from surface conduction electron-emitting devices in the lit state, and no surface conduction electron-emitting devices in the unlit state emit current.

A method of calculating compensation data for compensating image data from voltage drops will now be explained.

(Compensation Data Calculation Method)

Figure 17:
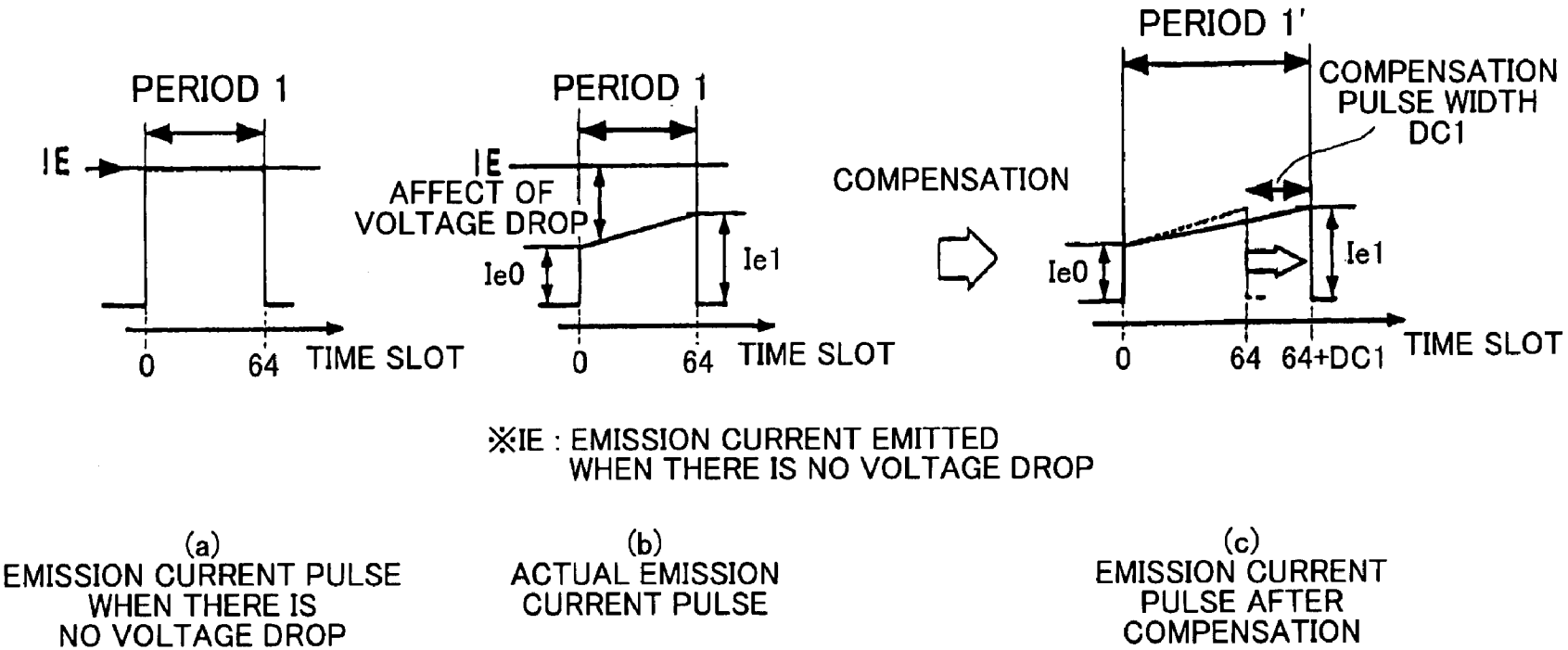
FIG. 17 is a view showing an example of computing compensation data when a value of image data is 64.

FIG. 17 is a view illustrating a method of calculating voltage drop compensation data from the change with time of emission current of FIG. 16. FIG. 17 shows an example of calculating compensation data for image data of 64.

The light emission level that is luminance corresponds to the emitted charge quantity obtained by integrating the emission current of the emission current pulse with respect to time. Therefore, in considering fluctuation in luminance caused by voltage drop, the following description will center on emitted charge quantity.

Now, if the emission current of when there is no affect of voltage drop is written IE and the time corresponding to one gradation of pulse width modulation is written $\Delta t$, then the emitted charge quantity Q0 that should be emitted by the emission current pulse when the image data is 64 can be expressed by multiplying the emission current pulse amplitude IE by the pulse width (64×Δt).

$$Q0=IE\times 64\times \Delta t \quad \text{(Exp. 12)}$$

However, in practice, the phenomenon of voltage drop in the scan line causing the emission current to fall arises.

An emitted charge quantity from the emission current pulse which takes into account voltage drop can be calculated approximately in the following way. That is, if the emission currents of time slot=0, 64 of node 2 are respectively written Ie0, Ie1 and it is approximated that the emission current changes linearly between Ie0 and Ie1 between 0 and 64, the emitted charge quantity Q1 over this period is the area of the trapezium in FIG. 17B.

That is, it can be calculated as:

$$Q1=(Ie0+Ie1)\times 64\times \Delta t\times 0.5 \quad \text{(Exp. 13)}$$

Next, it will be supposed that, as shown in FIG. 17C, to compensate the fall in emission current caused by voltage drop, when the pulse width is extended by DC1, the affect of voltage drop is eliminated.

When compensation of voltage drop is carried out and the pulse width is extended, it is conceivable that the emission current levels in the time slots will change, but here, for simplification, it will be assumed that, as shown in FIG. 17C, at time slot=0 the emission current is Ie0 and at time slot=(64+DC1) the emission current is Ie1.

And, the emission current between the time slot 0 and the time slot (64+DC1) will be approximated to the value on the straight line joining the two emission current points.

When this is done, the emitted charge quantity Q2 from the emission current pulse after compensation can be calculated as:

$$Q2=(Ie0+Ie1)\times (64+DC1)\times \Delta t\times 0.5 \quad \text{(Exp. 14)}$$

Supposing that this is equal to the above-mentioned Q0, $$IE\times 64\times \Delta t=(Ie0+Ie1)\times (64+DC1)\times \Delta t\times 0.5 \quad \text{(Exp. 15)}$$

Solving this for DC1, $$DC1=((2\times IE-Ie0-Ie1)/(Ie0+Ie1))\times 64 \quad \text{(Exp. 16)}$$

In this way, compensation data for when the image data was 64 was computed.

That is, with respect to image data of size 64 in the position of node 2, a compensation quantity CData=DC1 should be added.

Figure 18:
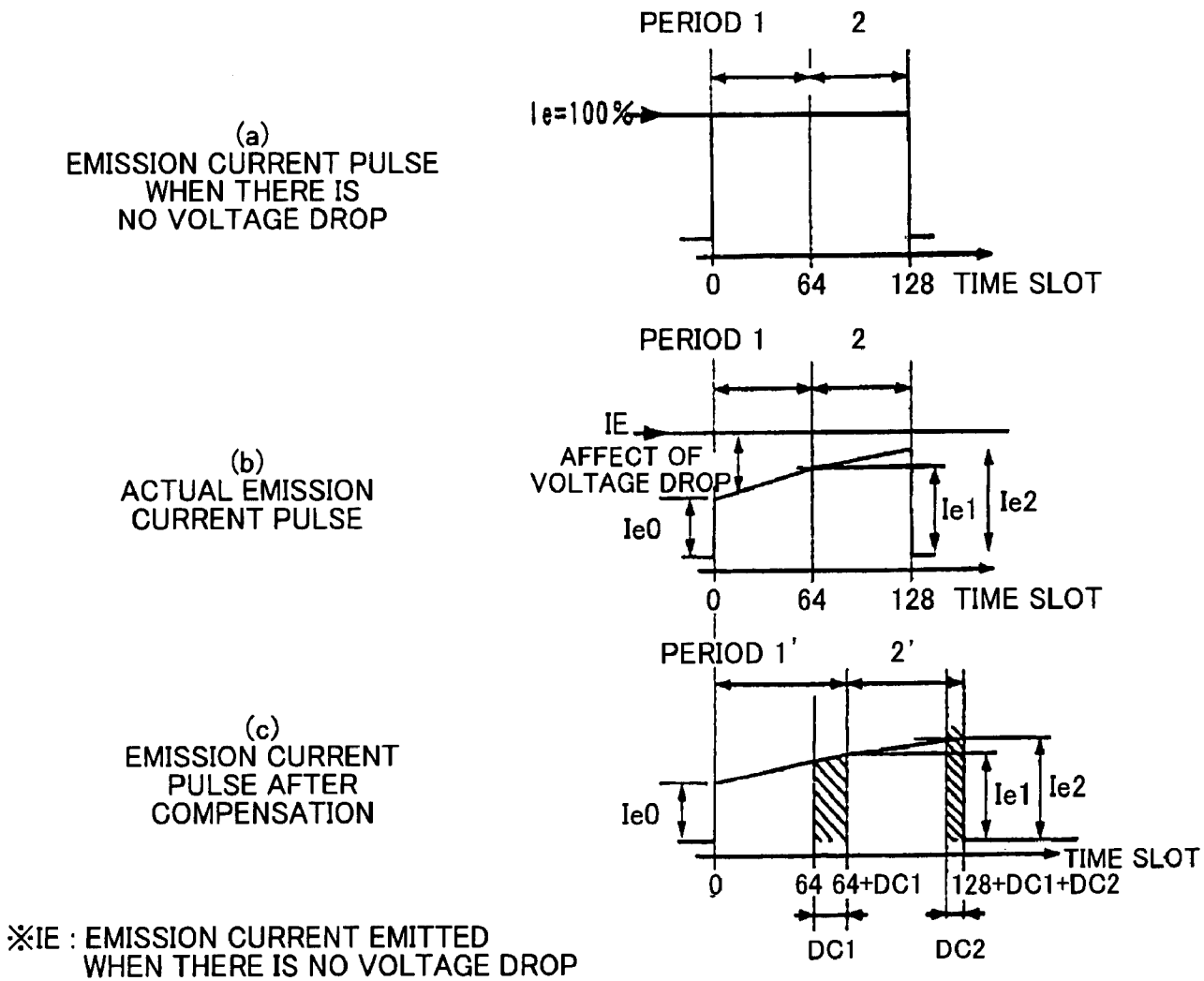
FIG. 18 is a view showing an example of computing compensation data when a value of image data is 128.
Figure 19:
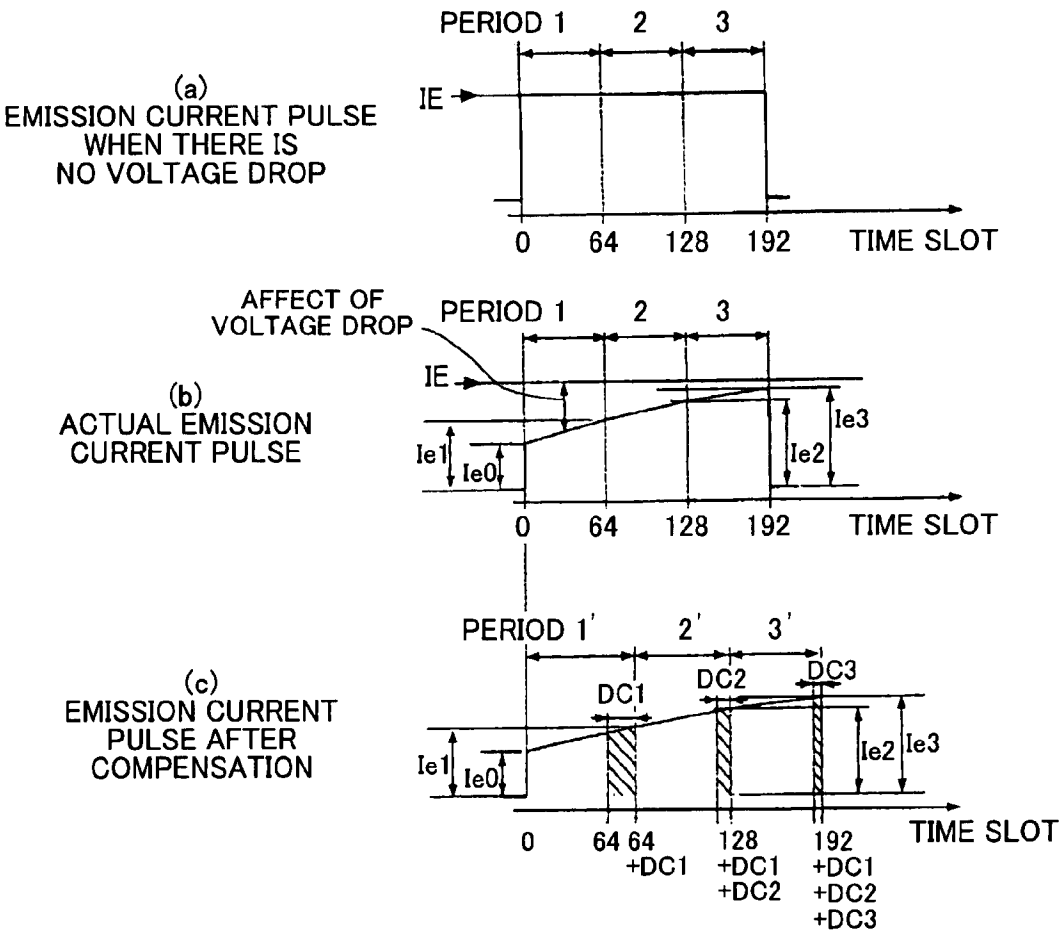
FIG. 19 is a view showing an example of computing compensation data when a value of image data is 192.

Compensation quantities can be obtained similarly for image data of size 128 with respect to two intervals as shown in FIGS. 18A through 18C and for image data of size 192 with respect to each of three intervals as shown in FIGS. 19A through 19C.

When the pulse width is 0, because of course there is no affect of voltage drop on the emission current, the compensation data is made 0 and the compensation data CData added to the image data is also made 0.

The reason for calculating compensation data with respect to image data of size steps as in 0, 64, 128, 192 like this is to reduce the amount of calculation.

Figure 20A:
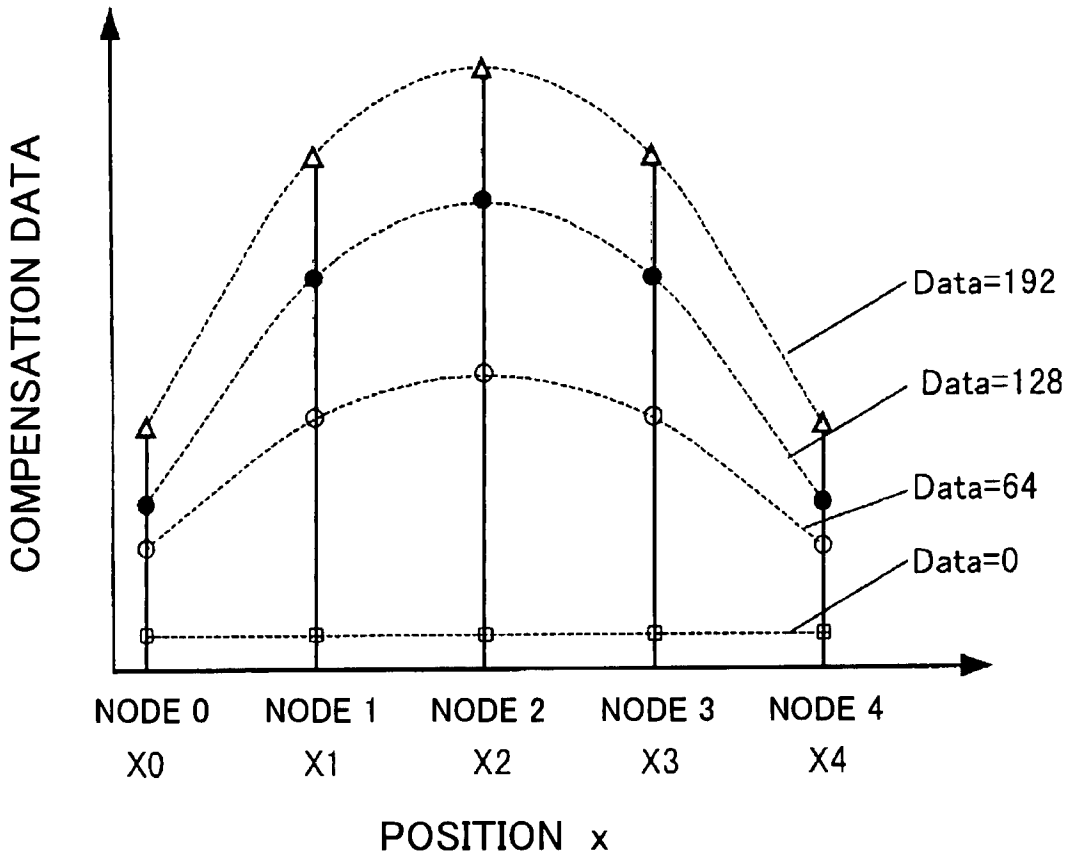
FIGS. 20A and 20B are views illustrating a compensated data interpolation method.

An example of discrete compensation data corresponding to certain input image data obtained by the method is shown in FIG. 20A. In this figure the horizontal axis corresponds to horizontal display position, and the positions of nodes are shown. The vertical axis shows size of compensation data.

The discrete compensation data have been calculated for the node positions and image data Data sizes (image data reference value=0, 64, 128, 192) shown with the white squares, the white dots, the black dots and the white triangles in the figure.

In this preferred embodiment, because as shown in FIGS. 7A and 7B the scanning circuits are connected to the ends of the row lines, the compensation data is smaller the closer are the ends of the row lines.

(Discrete Compensation Data Interpolation Method)

The discretely computed compensation data is discrete data pertaining to the positions of the nodes, and does not provide compensation data at all horizontal positions (column line numbers). And at the same time, it is compensation data for image data of the sizes of a number of preset image data reference values at the node positions, and does not provide compensation data corresponding to sizes of actual image data.

Accordingly, the inventors computed compensation data fitted to the sizes of the input image data at the column lines by interpolating the discretely computed compensation data.

Figure 20B:
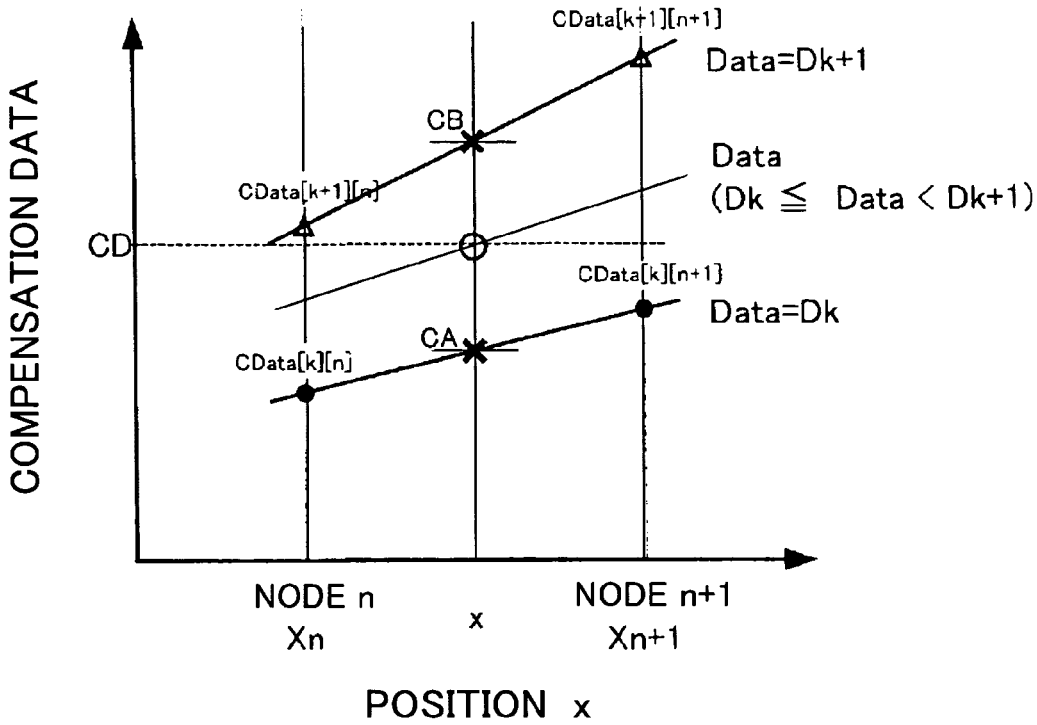

FIG. 20B is a view showing a method for computing compensation data corresponding to image data Data at a position x between a node n and a node n+1.

Here, it is assumed as a premise that compensation data has already been calculated discretely at the positions Xn and Xn+1 of the node n and the node n+1.

And, it is assumed that Data, the inputted image data, takes a value between image data reference values Dk and Dk+1.

Now, if the discrete compensation data for the reference value of the kth image data of the node n is written Data [k][n], the compensation data CA of the pulse width Dk at the position x can be calculated by straight line approximation using the values of CData [k][n] and CData [k][n+1] as follows:

$$CA=(Xn+1-x)\times \mathrm{CData}[k][n]+(x-Xn)\times \mathrm{CData}[k][n+1]/Xn+1-Xn \quad \text{(Exp. 17)}$$

Here, Xn and Xn+1 are the horizontal display positions of the nodes n and (n+1), and are constants set when the blocks are determined.

And, the compensation data CB of the image data Dk+1 at the position x can be calculated as follows:

$$CB=(Xn+1-x)\times \mathrm{CData}[k+1][n]+(x-Xn)\times \mathrm{CData}[k+1][n+1]/Xn+1-Xn \quad \text{(Exp. 18)}$$

By linearly approximating the compensation data CA and CB, it is possible to calculate compensation data CD for the image data Data at the position x as follows:

$$CD=CA\times (Dk+1-\mathrm{Data})+CB\times (\mathrm{Data}-Dk)/Dk+1-Dk \quad \text{(Exp. 19)}$$

Thus it is possible to compute compensation data fitted to the actual position and size of the image data from discrete compensation data by using the method shown in Exp. 17 through Exp. 19.

The dotted lines between the nodes in FIG. 20A are results obtained by interpolating discrete compensation data by the foregoing calculation. As is clear from the figure, with the voltage drop compensation method of this preferred embodiment, when the image data is 0, because no voltage drop occurs, the same compensation data is computed at any position x (also including of course the case of the compensation data being 0), and for identical image data which are not 0, compensation data having a distribution gently-sloping with respect to position x, i.e. the horizontal direction of the screen (the direction parallel with the scan lines) was computed.

By using an image display apparatus according to this preferred embodiment, it was possible to compensate the affects of phosphor saturation and voltage drop and display images well. And also when displaying moving pictures, by means of the novel gain control method, images could be displayed well.

Second Preferred Embodiment

In a second preferred embodiment, another construction for resolving issues of the invention will be described.

Figure 21A:
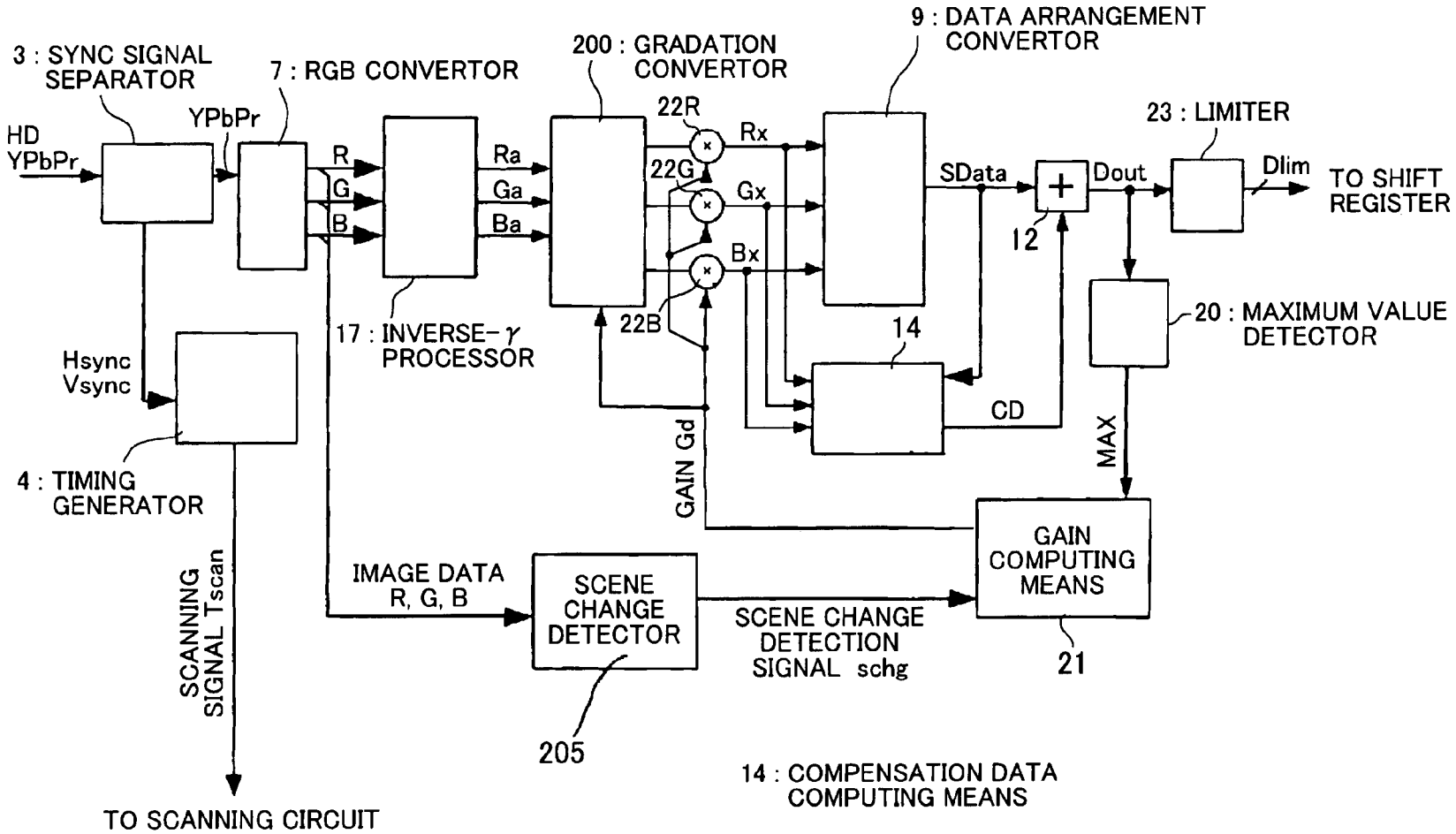
FIGS. 21A and 21B are block diagrams showing the construction of an image display apparatus of a second preferred embodiment.
Figure 21B:
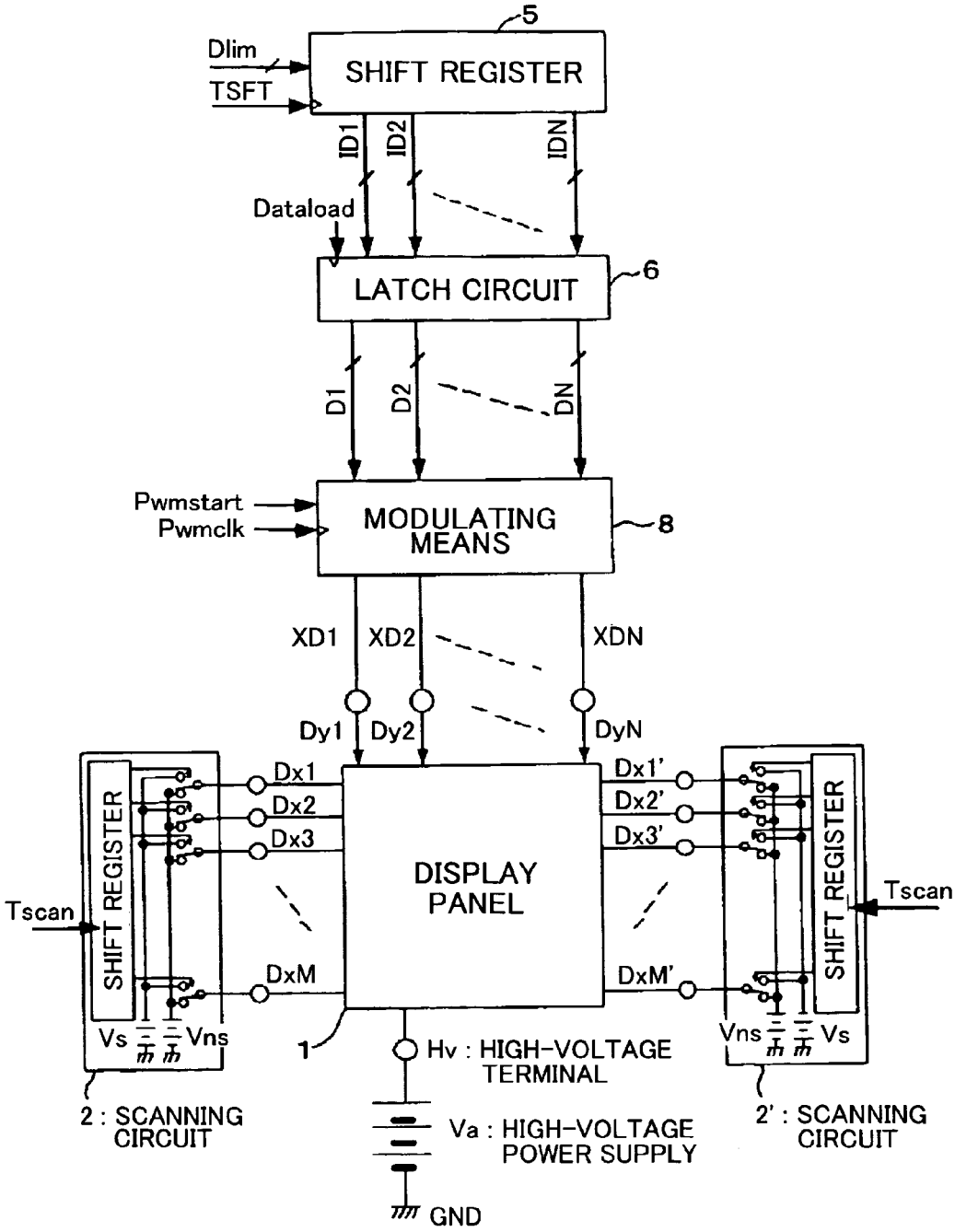
Figure 22:
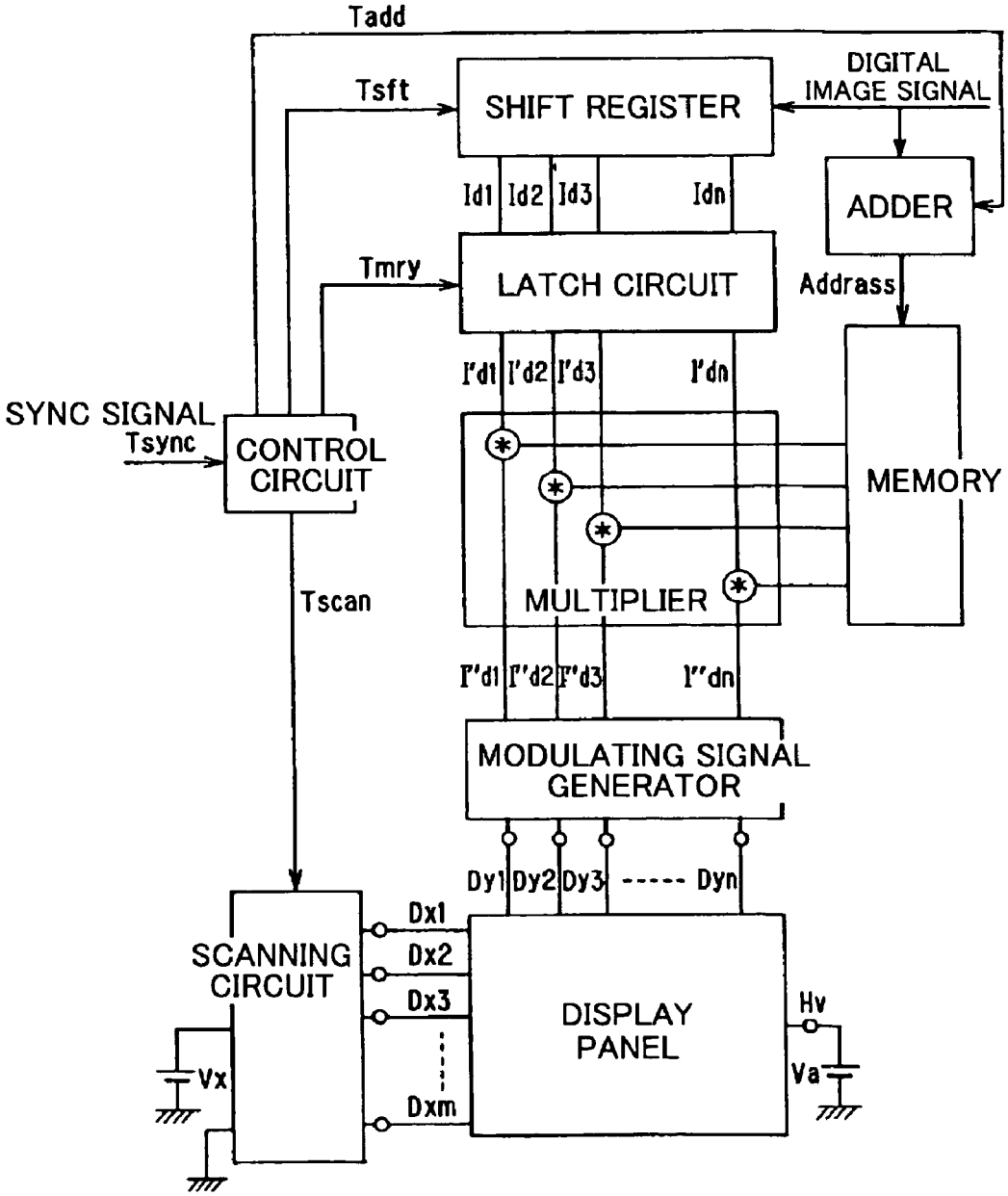
FIG. 22 is a block diagram showing the construction of an image display apparatus of related art.

FIG. 21 is a block diagram showing the construction of an image display apparatus according to the second preferred embodiment.

The difference between this and the first preferred embodiment is that whereas in the first preferred embodiment overflow processing was carried out by multiplying the compensated image data by again, in this preferred embodiment overflow processing is carried out by multiplying the image data from the gradation convertor by a gain.

That is, the construction of this preferred embodiment prevents overflow arising by pre-compressing the image data on which voltage drop compensation is to be carried out.

In this preferred embodiment, multipliers 22R, 22G and 22B constitute gain multiplying means.

With this kind of construction also it was possible to compensate the affects of phosphor saturation and voltage drop well.

And also in the control at times of scene change during moving picture display discussed in the first preferred embodiment, display could be effected well by performing filter processing in the same way as in the first preferred embodiment.

What is claimed is:

1. An image display apparatus, comprising:

multiple image-forming devices connected to multiple row lines and column lines and disposed in the form of a matrix;

scanning means connected to the row lines;

modulating means connected to the column lines;

image-forming members severally associated with the image-forming devices and having a nonlinear characteristic with respect to a driving condition of the image-forming devices;

gradation converting means for converting a gradation characteristic of inputted image data in accordance with the characteristic of the image-forming members;

compensated image data computing means for computing compensated image data by compensating the output of the gradation converting means for at least an effect of voltage drop arising due to resistance of the row lines;

amplitude regulating means for applying a gain for regulating the amplitude of the compensated image data so that the amplitude of the compensated image data corresponds with an input range of the modulating means; and a scene change detecting portion for detecting a change of a scene displayed on the image display apparatus, wherein the gradation converting means performs a gradation conversion corresponding to the gain, the amplitude regulating means has filtering means for carrying out different filter processing in accordance with the output of the scene change detecting portion on the gain computed for each frame, the modulating means receives the compensated image data amplitude-regulated by the amplitude regulating means as input and outputs a modulating signal to the column lines, and the filtering means does not perform filter processing with respect to a predetermined frame immediately after a scene change is detected by the scene change detecting portion and operates as a low pass filter with respect to frames other than the predetermined frame immediately after the scene change is detected.

2. An image display apparatus according to claim 1, wherein the predetermined frame is from one frame to five frames immediately after a scene change is detected by the scene change detecting portion.

3. An image display apparatus, comprising:

multiple image-forming devices connected to multiple row lines and column lines and disposed in the form of a matrix;

scanning means connected to the row lines;

modulating means connected to the column lines;

image-forming members severally associated with the image-forming devices and having a nonlinear characteristic with respect to a driving condition of the image-forming devices;

gradation converting means for converting a gradation characteristic of inputted image data in accordance with the characteristic of the image-forming members;

compensated image data computing means for computing compensated image data by compensating the output of the gradation converting means for at least an effect of voltage drop arising due to resistance of the row lines;

amplitude regulating means for applying a gain for regulating the amplitude of the compensated image data so that the amplitude of the compensated image data corresponds with an input range of the modulating means; and a scene change detecting portion for detecting a change of a scene displayed on the image display apparatus, wherein the gradation converting means performs a gradation conversion corresponding to the gain, the amplitude regulating means has filtering means for carrying out different filter processing in accordance with the output of the scene change detecting portion on the gain computed for each frame, the modulating means receives the compensated image data amplitude-regulated by the amplitude regulating means as input and outputs a modulating signal to the column lines, and the filtering means, with respect to a predetermined frame immediately after a scene change is detected by the scene change detecting portion, alters the value of the gain to a value estimated with reference to an average value of inputted image data of the frame, and with respect to frames other than the predetermined frame immediately after the scene change is detected operates as a low pass filter.

4. An image display apparatus according to claim 3, wherein the predetermined frame is from one frame to five frames immediately after a scene change is detected by the scene change detecting portion.

5. An image display apparatus, comprising:

multiple image-forming devices connected to multiple row lines and column lines and disposed in the form of a matrix;

scanning means connected to the row lines;

modulating means connected to the column lines;

image-forming members severally associated with the image-forming devices and having a nonlinear characteristic with respect to a driving condition of the image-forming devices;

gradation converting means for converting a gradation characteristic of inputted image data in accordance with the characteristic of the image-forming members;

compensated image data computing means for computing compensated image data by compensating the output of the gradation converting means for at least an effect of voltage drop arising due to resistance of the row lines;

amplitude regulating means for applying a gain for regulating the amplitude of the compensated image data so that the amplitude of the compensated image data corresponds with an input range of the modulating means; and a scene change detecting portion for detecting a change of a scene displayed on the image display apparatus, wherein the gradation converting means performs a gradation conversion corresponding to the gain, the amplitude regulating means has filtering means for carrying out different filter processing in accordance with the output of the scene change detecting portion on the gain computed for each frame, the modulating means receives the compensated image data amplitude-regulated by the amplitude regulating means as input and outputs a modulating signal to the column lines, and the scene change detecting portion has means for computing an average value of inputted image data for each frame and means for calculating a difference in the average value between frames and comparing the absolute value of this difference with a preset value to determine whether or not there has been a scene change.

6. An image display apparatus, comprising:

multiple image-forming devices connected to multiple row lines and column lines and disposed in the form of a matrix;

scanning means connected to the row lines;

modulating means connected to the column lines;

image-forming members severally associated with the image-forming devices and having a nonlinear characteristic with respect to a driving condition of the image-forming devices;

gradation converting means for converting a gradation characteristic of inputted image data in accordance with the characteristic of the image-forming members;

gain multiplying means for multiplying an output of the gradation converting means by a gain;

compensated image data computing means for computing compensated image data by compensating the image data gain-multiplied by the gain multiplying means for at least an effect of voltage drop arising due to resistance of the row line;

gain computing means for computing the gain so that the amplitude of the compensated image data corresponds with an input range of the modulating means; and a scene change detecting portion for detecting a change of a scene displayed on the image display apparatus, wherein the gradation converting means performs a gradation conversion corresponding to the gain, a filtering means for carrying out different filter processing in accordance with the output of the scene change detecting portion on the gain computed for each frame is provided, the modulating means receives the compensated image data amplitude-regulated by the amplitude regulating means as input and outputs a modulating signal to the column lines, and the filtering means does not perform filter processing with respect to a predetermined frame immediately after a scene change is detected by the scene change detecting portion and operates as a low pass filter with respect to frames other than the predetermined frame immediately after the scene change is detected.

7. An image display apparatus according to claim 6, wherein the predetermined frame is from one frame to five frames immediately after a scene change is detected by the scene change detecting portion.

8. An image display apparatus, comprising:

multiple image-forming devices connected to multiple row lines and column lines and disposed in the form of a matrix;

scanning means connected to the row lines;

modulating means connected to the column lines;

image-forming members severally associated with the image-forming devices and having a nonlinear characteristic with respect to a driving condition of the image-forming devices;

gradation converting means for converting a gradation characteristic of inputted image data in accordance with the characteristic of the image-forming members;

gain multiplying means for multiplying an output of the gradation converting means by a gain;

compensated image data computing means for computing compensated image data by compensating the image data gain-multiplied by the gain multiplying means for at least an effect of voltage drop arising due to resistance of the row line;

gain computing means for computing the gain so that the amplitude of the compensated image data corresponds with an input range of the modulating means; and a scene change detecting portion for detecting a change of a scene displayed on the image display apparatus, wherein the gradation converting means performs a gradation conversion corresponding to the gain, a filtering means for carrying out different filter processing in accordance with the output of the scene change detecting portion on the gain computed for each frame is provided, the modulating means receives the compensated image data amplitude-regulated by the amplitude regulating means as input and outputs a modulating signal to the column lines, and the filtering means, with respect to a predetermined frame immediately after a scene change is detected by the scene change detecting portion, alters the value of the gain to a value estimated with reference to an average value of inputted image data of the frame, and with respect to frames other than the predetermined frame immediately after the scene change is detected operates as a low pass filter.

9. An image display apparatus according to claim 8, wherein the predetermined frame is from one frame to five frames immediately after a scene change is detected by the scene change detecting portion.

10. An image display apparatus, comprising:

multiple image-forming devices connected to multiple row lines and column lines and disposed in the form of a matrix;

scanning means connected to the row lines;

modulating means connected to the column lines;

image-forming members severally associated with the image-forming devices and having a nonlinear characteristic with respect to a driving condition of the image-forming devices;

gradation converting means for converting a gradation characteristic of inputted image data in accordance with the characteristic of the image-forming members;

gain multiplying means for multiplying an output of the gradation converting means by a gain;

compensated image data computing means for computing compensated image data by compensating the image data gain-multiplied by the gain multiplying means for at least an effect of voltage drop arising due to resistance of the row line;

gain computing means for computing the gain so that the amplitude of the compensated image data corresponds with an input range of the modulating means; and a scene change detecting portion for detecting a change of a scene displayed on the image display apparatus, wherein the gradation converting means performs a gradation conversion corresponding to the gain, a filtering means for carrying out different filter processing in accordance with the output of the scene change detecting portion on the gain computed for each frame is provided, the modulating means receives the compensated image data amplitude-regulated by the amplitude regulating means as input and outputs a modulating signal to the column lines, and the scene change detecting portion has means for computing an average value of inputted image data for each frame and means for calculating a difference in the average value between frames and comparing the absolute value of this difference with a preset value to determine whether or not there has been a scene change.

* * * * *

UNITED STATES PATENT AND TRADEMARK OFFICE

CERTIFICATE OF CORRECTION

PATENT NO. : 7,280,125 B2
APPLICATION NO. : 10/775083
DATED : October 9, 2007
INVENTOR(S) : Osamu Sagano et al.

It is certified that error appears in the above-identified patent and that said Letters Patent is hereby corrected as shown below:

ON THE TITLE PAGE
Item (57), Abstract, line 9, “affects” should read --effects--.

COLUMN 1
Line 30, “affect” should read --effect--.
Line 39, “affect” should read --effect--.

COLUMN 2
Line 13, “affect” should read --effect--.
Line 35, “affect” should read --effect--.
Line 49, “affect” should read --effect--.

COLUMN 3
Line 7, “affect” should read --effect--.
Line 21, “affect” should read --effect--.

COLUMN 4
Line 6, “affects” should read --effects--.

COLUMN 6
Line 52, “them” should read --they--.

COLUMN 8
Line 33, “affect” should read --effect--.
Line 45, “affect” should read --effect--.
Line 47, “affect” should read --effect--.

COLUMN 11
Line 8, “described” should read --described.--.

COLUMN 14
Line 57, “affects” should read --effects--.

UNITED STATES PATENT AND TRADEMARK OFFICE

CERTIFICATE OF CORRECTION

PATENT NO. : 7,280,125 B2
APPLICATION NO. : 10/775083
DATED : October 9, 2007
INVENTOR(S) : Osamu Sagano et al.

It is certified that error appears in the above-identified patent and that said Letters Patent is hereby corrected as shown below:

COLUMN 21
Line 52, "affect" should read --effect--.

COLUMN 23
Line 25, "affects" should read --effects--.

Signed and Sealed this

First Day of April, 2008

JON W. DUDAS
*Director of the United States Patent and Trademark Office*